US005398949A

United States Patent [19]

Tarng

[11] Patent Number: 5,398,949

[45] Date of Patent: Mar. 21, 1995

[54] TANGS FIGURE-BLADE ROLLER SKATE

[76] Inventor: Min M. Tarng, 1367 Glenmoor Way, San Jose, Calif. 95129

[21] Appl. No.: 923,225

[22] Filed: Jul. 31, 1992

Related U.S. Application Data

[63] Continuation-in-part of Ser. No. 662,717, Mar. 1, 1991, abandoned.

[51] Int. Cl.[6] ..... A63C 17/04

[52] U.S. Cl. ..... 280/11.22; 240/11.2; 240/11.28

[58] Field of Search ..... 280/11.22, 11.23, 11.2, 280/11.27, 11.28, 11.115, 87.042

[56] References Cited

U.S. PATENT DOCUMENTS

| | | | |
|---|---|---|---|
| 1,437,314 | 11/1922 | Jorgensen | 280/11.115 |
| 1,761,807 | 6/1930 | Von Etten | 280/11.115 |
| 1,784,701 | 12/1930 | Smith | 280/11.115 |
| 3,963,252 | 6/1976 | Carlson | 280/11.22 |
| 4,915,403 | 4/1990 | Wild et al. | 280/11.115 |
| 5,048,848 | 9/1991 | Olson et al. | 280/11.22 |
| 5,246,238 | 9/1993 | Braun | 280/11.2 |

*Primary Examiner*—Richard M. Camby

[57] ABSTRACT

The figure-blade roller skate costitutes the steering cushion mechanism. Due to the steering cushion mechanism, as the roller blade skate tilts, the wheels are aligned on a curved track. Shifting the body weight right, the steering cushion mechanism will cause the rollers to curve to the right; shifting the body weight left, the steering cushion mechanism will cause the rollers to curve to the left. The brake wheel uses the clamping force to brake the skate to stop. The brake wheel can serve as both wheel and brake.

25 Claims, 32 Drawing Sheets

TANGS FIGURE-BLADE ROLLER SKATE

This is a continuation-in-part of Ser. No. 07/662,717, filed Mar. 1, 1991, now abandonded.

BACKGROUND-FIELD OF INVENTION

This invention is related to figure-blade roller skate which can make figure skate.

BACKGROUND-DESCRIPTION OF PRIOR ART

The in-line blade roller skate is the most popular roller skate today. There are three to five wheels lining in one line. There are several strickt restrictions for today's in line roller skate. Today's in-line roller skate doesn't have the figure skate capability. It cannot skate the figure pattern of circle, 3 and 8, etc. Furthermore, the roller blade skate doesn't have the capability to make the right turn and left turn during the single foot skating. It strictly limits the in-line roller blade skate to be solely adopted in sports of race and hockey.

To meet the versatile requirements of figure skating, I invent the in-line roller figure skate which has the capability to skate forward, backward, turn right and left with smooth sliding and soft landing feeling. The self-propelling technology which had been disclosed in the application Ser. No. 07/662,717 is adopted that the figure-blade roller skate has the self-propelling capability. With this self-propelling capability, the skater can continuously skate with one single foot only. Furthermore, I extend the technological innovation to the skateboard design.

OBJECTS AND ADVANTAGES

Applying the technological breakthroughs in self-propelling, automatic-steering cushion mechanism and pivotal turnable brake wheel to the figure-blade roller skate design, the figure-blade roller skate can skate forward, backward, spin and turn left and right with one single foot only.

DRAWING FIGURES

FIG. 1 (A) is the side view of the figure-blade roller skate; FIG. 1 (B) is the partially exposed side view of the figure-blade roller skate.

FIG. 2 (A–E) is the partially exposed side view of the steering cushion mechanism; FIG. 2 (A) is the first front steering cushion; FIG. 2 (B) is the second front steering cushion; FIG. 2 (C) is the middle steering cushion; FIG. 2 (D) is the fourth steering cushion; FIG. 2 (E) is the last steering cushion.

FIG. 3 (A–E) is the partially exposed side view of the wheels; FIG. 3 (A) is the sectional view of the front wheel; FIG. 3 (B) is the sectional view of the second wheel; FIG. 3 (C) is the sectional view of the middle wheel; FIG. 3 (D) is the sectional view of the fourth wheel; FIG. 3 (E) is the sectional view of the last wheel.

FIG. 4 (A–E) is the top section view of the wheels in the right turn; FIG. 4 (A) is the first front wheel in the right turn; FIG. 4 (B) is the second wheel in the right turn; FIG. 4 (C) is the middle wheel in the right turn; FIG. 4 (D) is the fourth wheel in the right turn; FIG. 4 (E) is the last wheel in the right turn.

FIG. 5 (A–E) is the top section view of wheels in the left turn; FIG. 5 (A) is the first front wheel in the left turn; FIG. 5 (B) is the second wheel in the left turn; FIG. 5 (C) is the middle wheel in the left turn; FIG. 5 (D) is the fourth wheel in the left turn; FIG. 5 (E) is the last wheel in the left turn.

FIG. 6 (A–C) is the enlarged section view of the cushion mechanisms; FIG. 6 (A) is the cushion mechanism inclining forward for the front wheel; FIG. 6 (B) is the cushion mechanism aligned vertically for the middle wheel; FIG. 6 (C) is the cushion mechanism inclining backward for the rear wheel.

FIG. 7 (A–B) is the partially exposed section view of the middle wheel; FIG. 7 (A) is the cross section view of the middle wheel; FIG. 7 (B) is the elevational side view of the cushion mechanism for the middle wheel.

FIG. 8 (A–B) is the alternative design of the steering cushion mechanism; FIG. 8 (A) is the section view of the resilient cushion mechanism; FIG. 8 (B) is the elevational side view of the resilient cushion mechanism.

FIG. 9 (A–B) is the alternative design of the steering cushion mechanism; FIG. 9 (A) is the section view of the resilient cushion mechanism; FIG. 9 (B) is the elevational side view of the resilient cushion mechanism.

FIG. 10 is the partially exposed elevational side section view of the figure-blade roller skate made of the alternative design of the resilient cushion mechanism and brake wheel.

FIG. 11 (A–B) is the alternative design of the steering cushion mechanism; FIG. 11 (A) is the section view of the resilient cushion mechanism; FIG. 11 (B) is the elevational side view of the resilient cushion mechanism.

FIG. 12 (A–C) is the cross section view of the middle wheel; FIG. 12 (A) is the sectional view of the wheel in the straight forward position; FIG. 12 (B) is the sectional view of the wheel in the right turn; FIG. 12 (C) is the sectional view of the wheel in the left turn.

FIG. 13 (A–C) is the mechanism of the wheel with single rim; FIG. 13 (A) is the mechanism of the wheel in the neutral position; FIG. 13 (B) is the mechanism of the wheel in the right turn position; FIG. 13 (C) is the mechanism of the wheel in the left turn position.

FIG. 14 (A–C) is the mechanism of the wheel with dual rims; FIG. 14 (A) is the mechanism of the wheel in the neutral position; FIG. 14 (B) is the mechanism of the wheel in the right turn position; FIG. 14 (C) is the mechanism of the wheel in the left turn position.

FIG. 15 (A–B) is the steering cushion mechanism of the front wheel with forward guiding slot; FIG. 15 (A) is the steering cushion mechanism in right turning; the wheel turns right; FIG. 15 (B) is the steering cushion mechanism in left turning; the wheel turns left.

FIG. 16 (A–B) is the steering cushion mechanism of the rear wheel with backward guiding slot; FIG. 16 (A) is the steering cushion mechanism in right turning; the wheel turns left; FIG. 16 (B) is the steering cushion mechanism in left turning; the wheel turns right.

FIG. 17 (A–B) is the graphical representation of the functions of the mechanism; FIG. 17 (A) is the graphical representation of the function of front wheels; FIG. 17 (B) is the graphical representation of the function of rear wheels.

FIG. 18 (A–B) is the tail roller serving as the brake with the alternative design of the hub being made of the frictional-endurable material; FIG. 18 (A) is the partially exposed section view of the tail roller along A—A line in FIG. 18B; FIG. 18 (B) is the side elevational view of the tail roller.

FIG. 19 (A–B) is the tail roller serving as an extra wheel; FIG. 19 (A) is the partial exposed section view of the tail roller along B—B line in FIG. 19B; FIG. 19 (B) is the side elevational view of the tail roller.

FIG. 20 (A–B) is the alternative design of the brake wheel; FIG. 20 (A) is the tail roller serving as the brake; FIG. 20 (B) is the tail roller serving as an extra wheel.

FIG. 21 (A–B) is the alternative design of the brake wheel; FIG. 21 (A) is the tail roller serving as the brake; FIG. 21 (B) is the tail roller serving as an extra wheel.

FIG. 22 (B) is the skate having the sideward skating capability and it can skate on the ice, too.

FIG. 45 (B) is the side section view of the resilient cushion.

DESCRIPTION

In my invention, I have made three fundamental breakthroughs in the skate and skateboard. The fundamental breakthroughs are (1) self-propelling mechanism; (2) steering cushion mechanism and (3) pivotal-turnable brake wheel. With the versatile combinations of the fundamental breakthoughs, a series of new products of skates and skateboards are invented.

Figure 1A:
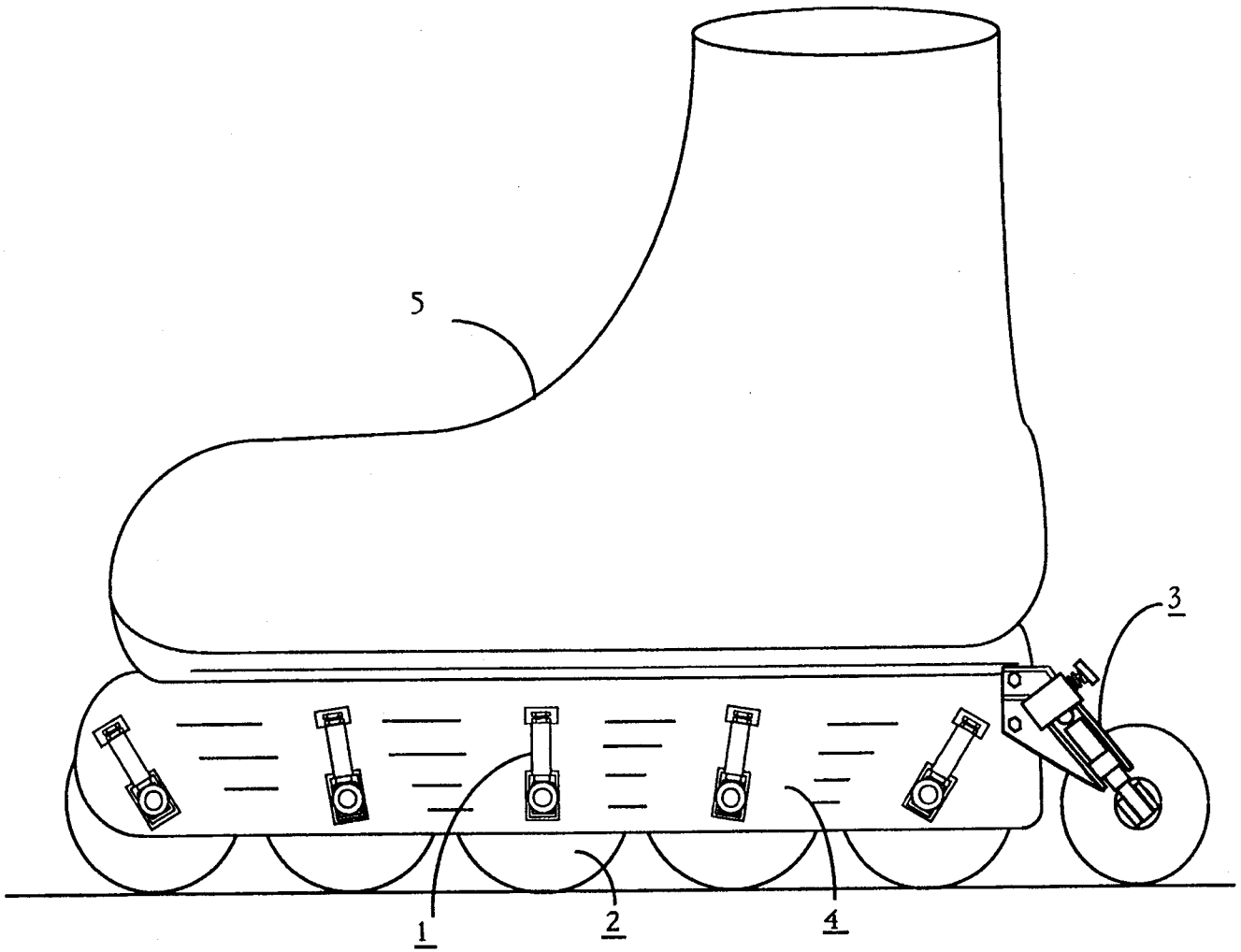
Figure 1B:
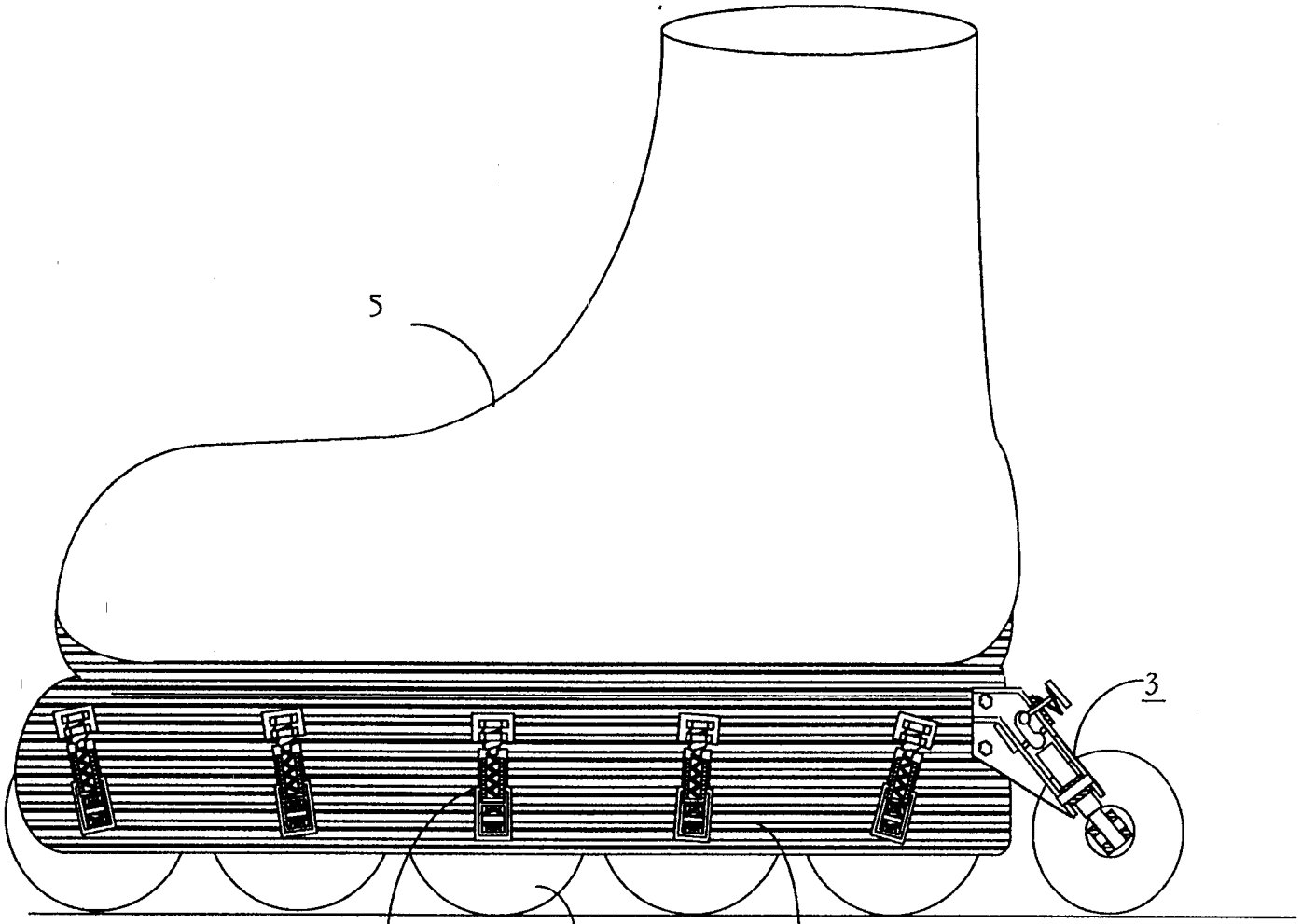

FIG. 1A is the basic version of the figure-blade roller skate equipped with the steering cushion mechanism 1 and pivotal-turnable brake wheel mechanism 3. The brake 3 is mounted at the end of the frame 4. The boot 5 is mounted on the frame 4. In FIG. 1B, it shows the partially exposed section view of the steering cushion mechanism 1 and pivotal-turnable brake wheel mechanism 3. The inclination angles of each of the steering cushion mechanisms 1 are different. The steering cushion mechanisms of the front wheels tilt forward; the steering cushion mechanisms of the rear wheels tilt backward.

From FIG. 2 to FIG. 5, are the results and designs of the steering cushion mechanism 1. The designs and operations of the steering cushion mechanism 1 are explained in details from FIG. 6 to FIG. 17.

In FIG. 2, the front steering cushion mechanism 101, the second steering cushion mechanism 102, the middle steering cushion mechanism 103, the fourth steering cushion mechanism 104 and the rear steering cushion mechanism 105 are aligned with different inclination angles. In FIG. 3, the front wheel 201, the second wheel 202, the middle wheel 203, the fourth wheel 204 and the rear wheel 205 are suggested to have different sections. With the arrangement of the cushion mechanisms and wheels, as shown in FIG. 4, the track made of the wheels curves to the right as the skater shifts the body weight to the right side. As shown in FIG. 5, as the skater shifts the body weight to the left side, the track made of the wheels curves to the left.

Figures 6A, 6B, 6C:
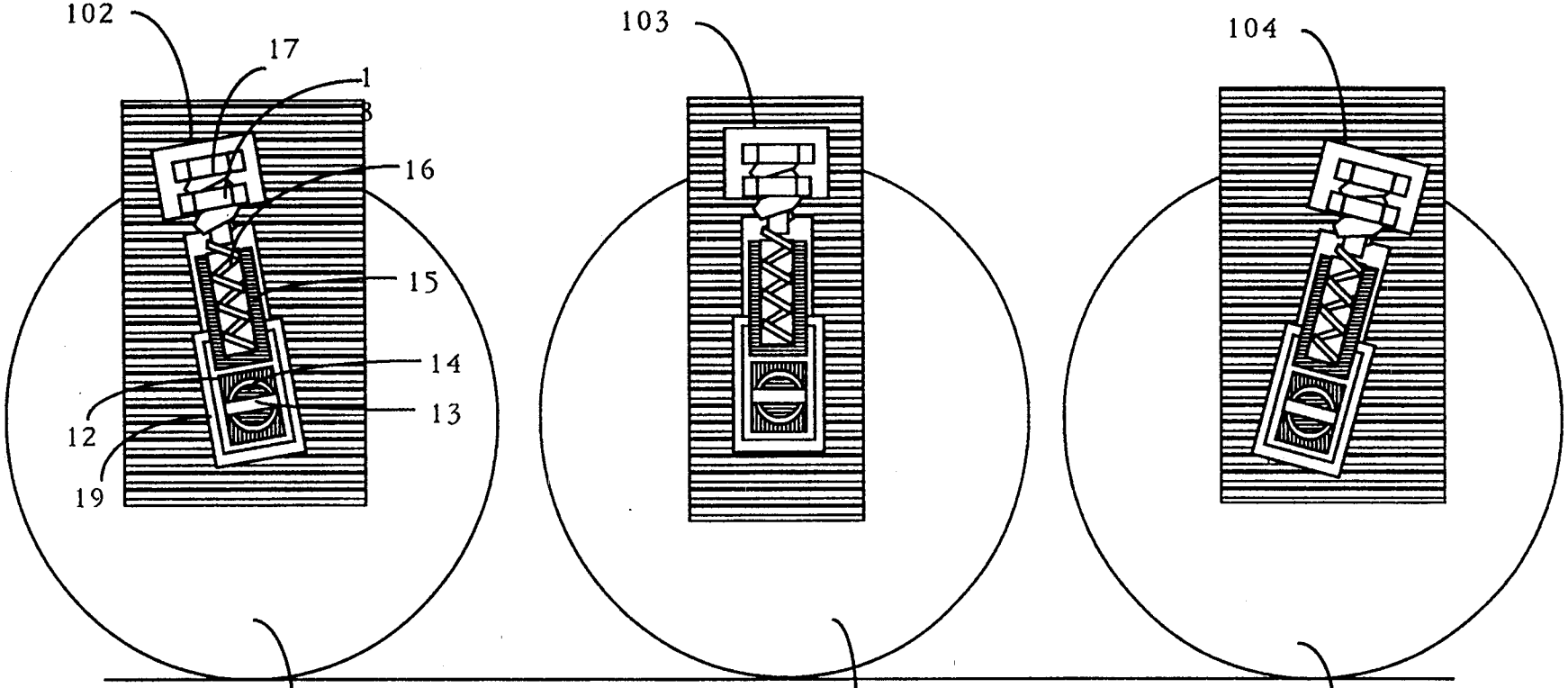

The enlarged details of the cushion mechanism 1 is shown in FIG. 6. The screw 17 adjusts the compressive force in the spring 16 to keep the axle 14 in the proper level position. The locking nut 18 is to lock the screw 17 at the fixed position. As shown in FIG. 7, the axle 14 is pivotally mounted in the parabolic hole of the sliding plug 12 with the pin 13. The gudgeon of the axle 14 fits in the cup joint of the sliding plug 12.

Figure 7B:
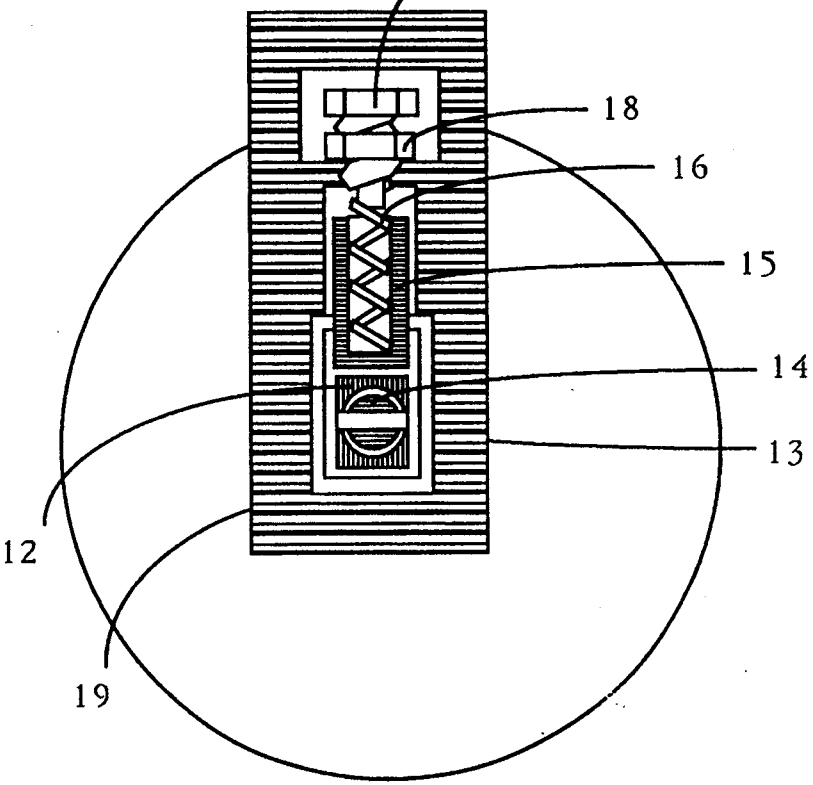
Figure 7A:
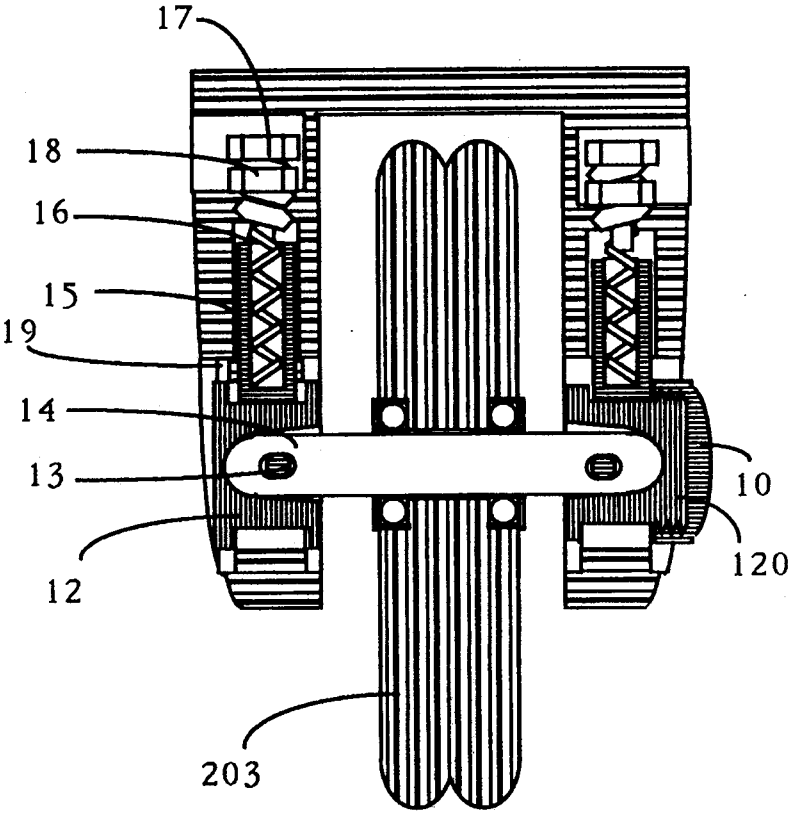

In FIG. 7A, on the right side, it shows the alternative design of the sliding plug. To be convenient for assembling, the cap 10 is screwed on the sliding plug 120. FIG. 7B is the side view of the cushion mechanism as shown in FIG. 7A.

Figure 8B:
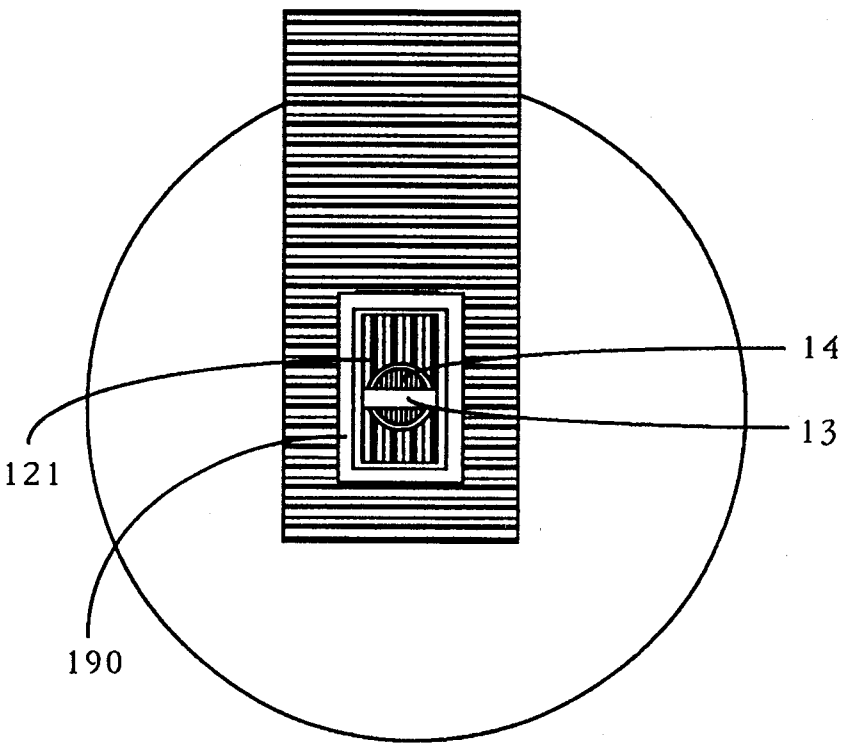
Figure 8A:
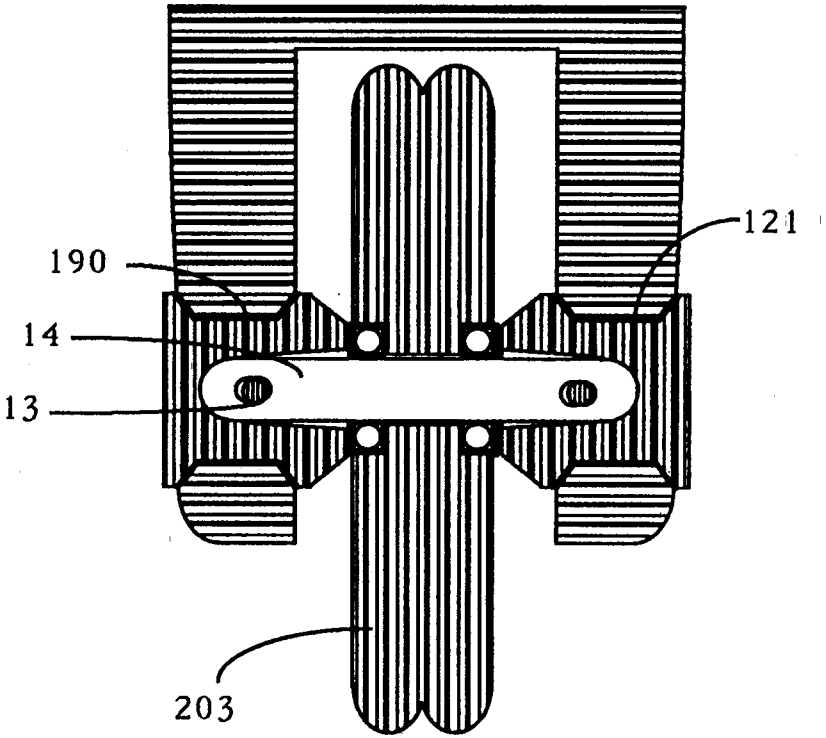
Figure 9B:
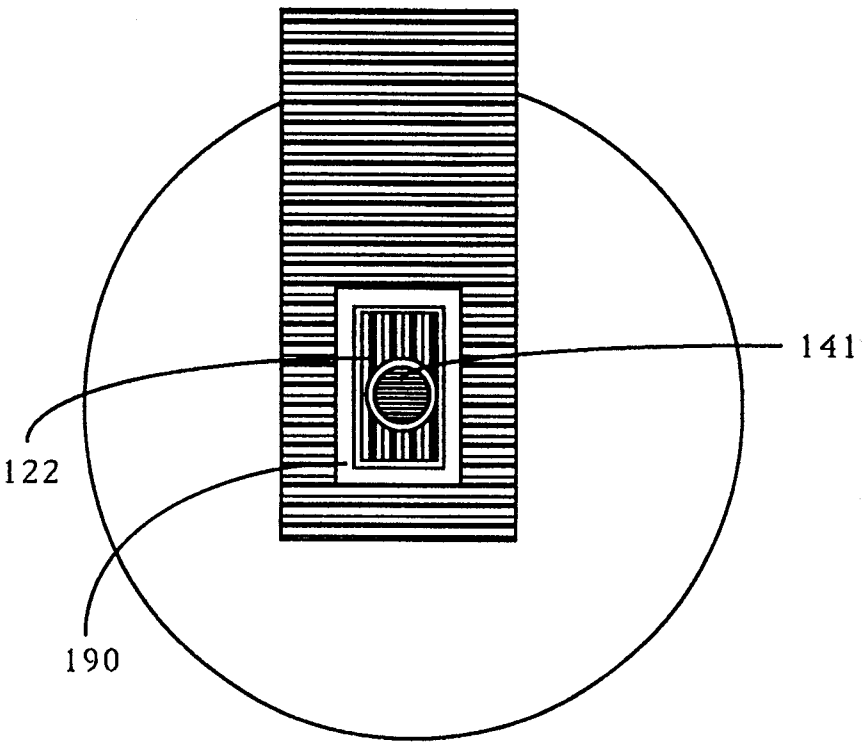
Figure 9A:
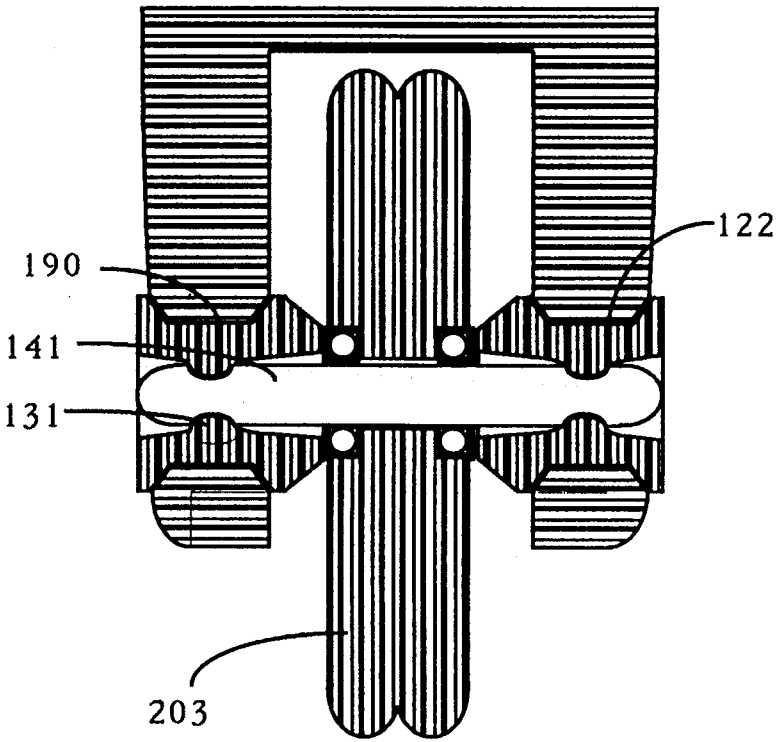
Figure 10:
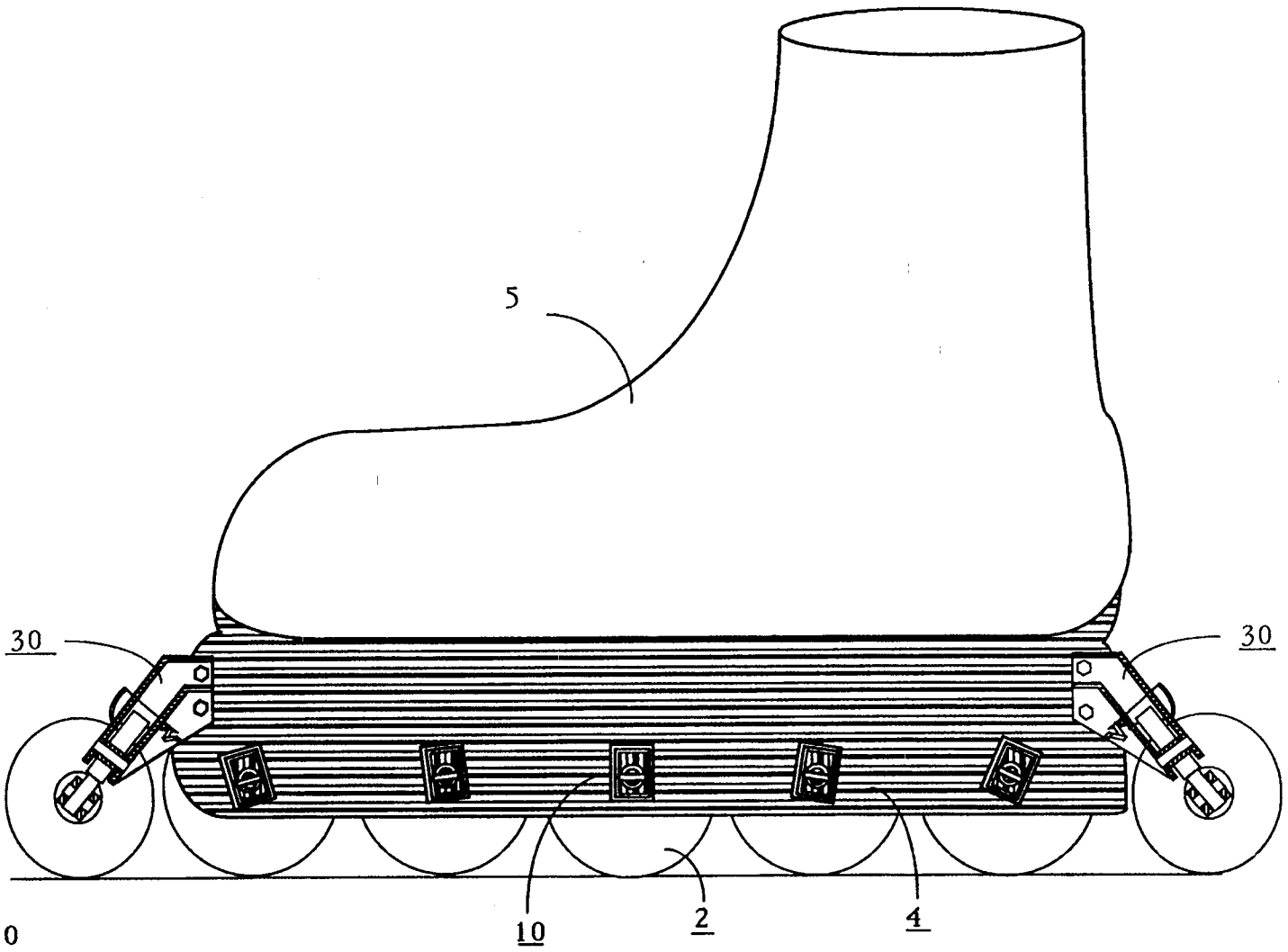
Figure 11B:
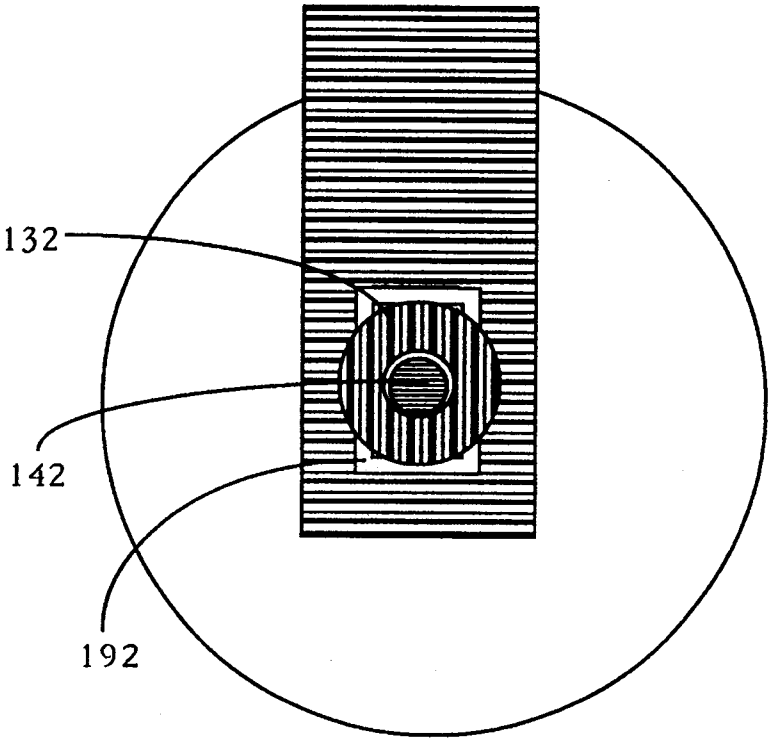
Figure 11A:
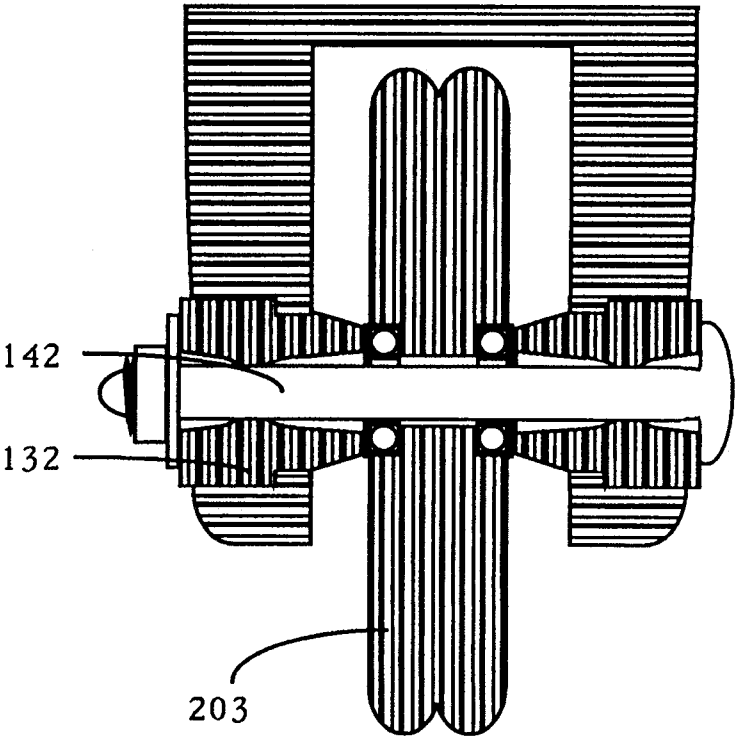

To reduce the cost of the steering cushion mechanism, in FIG. 8, FIG. 9 and FIG. 11, there are three different steering cushion mechanism made of the resilient materials. In FIG. 8, the axle 14 fits in the parabolic concave hole of the resilient cushion 121. The peripheral of cushion 121 enwraps the slot 190 to keep the steering cushion mechanism in position. The pin 13 passes through the resilient cushion 121 and fits in the slots in the axle 14. FIG. 9 is the alternative design of the resilient cushion 122. There is no pin in this design. The protrude 131 fits in the radial slot of axle 141. FIG. 10 is the elevational side view of the figure-blade roller skate equiped with the resilient cushion mechanism. The resilient cushion mechanism 10 of the front wheel inclines forward; the resilient cushion mechanism 10 of the rear wheel inclines backward. The pivotal-turnable brake wheel 30 is the alternative design of the brake wheel as shown in FIG. 21.

FIG. 11 is another alternative design of the resilient cushion mechanism. The resilient cushion 132 is clamped in the hole of frame 4. The axle 142 fits in the hyperbolic hole of the resilient cushion mechanism 132. It is the simplest and the best design of the steering cushion mechanism. It can be adapted to the conventional in-line roller skate with the minor modifications of the slots 192.

FIG. 12 shows the basic operations of the wheel during the shift of the body weight. FIG. 13 shows the mechanism of single rim wheel with the vertically aligned steering cushion mechanism; FIG. 14 shows the mechanism of dual rim wheel with the vertically aligned steering cushion mechanism. FIG. 15 shows the mechanism of the forward inclining cushion mechanism 101 of the front wheel 201. FIG. 16 shows the mechanism of the backward inclining cushion mechanism 105 of the rear wheel 205.

Figures 12A, 12B, 12C:
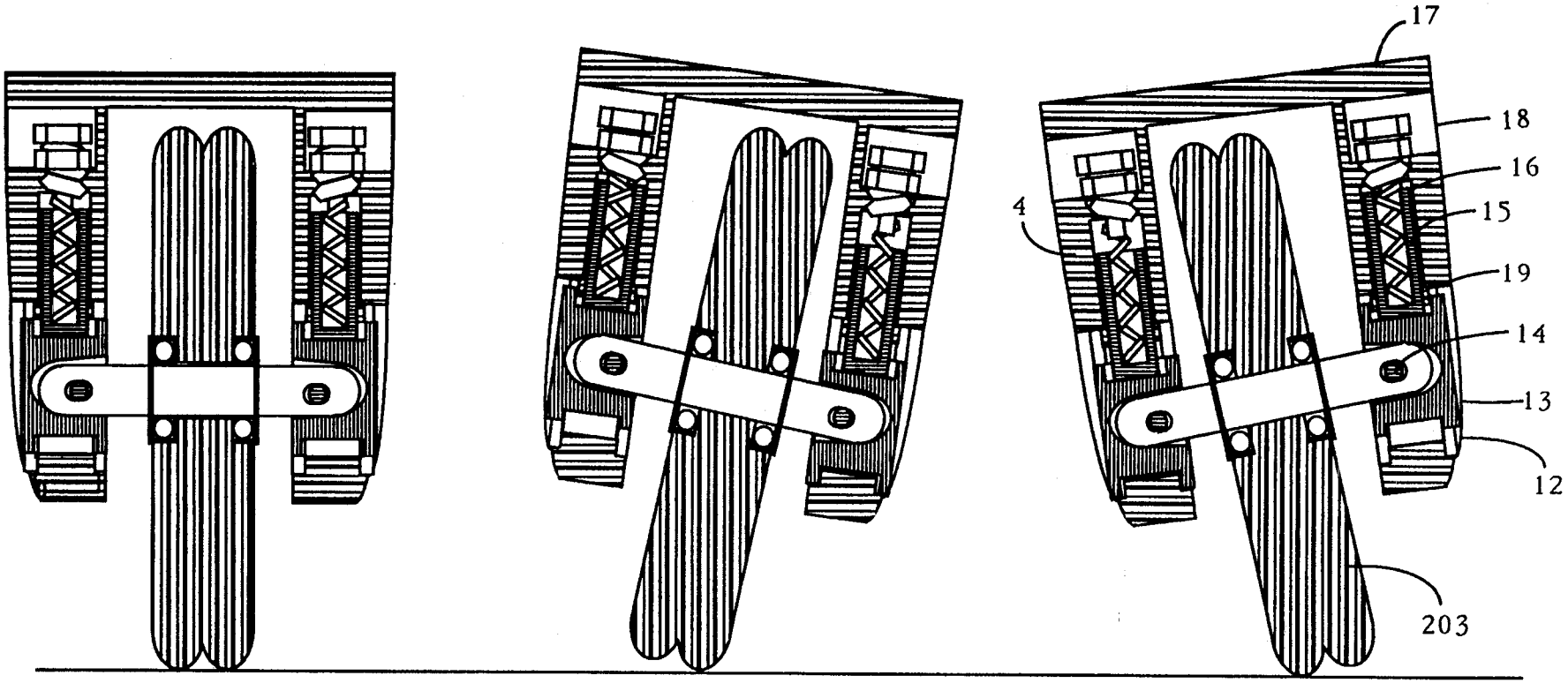

In FIG. 12A, as the skater loads the weight evenly on the frame 4 and the frame 4 is horizontal. The wheel 203 is in the vertical position. For the single rim wheel, in FIG. 13A, the ground force $F_G$ is applied to the bottom of the wheel. The reaction force $F_L$ applied to the left sliding plug 12 is equal to the reaction force $F_R$ applied to the right sliding plug 12. For the dual rim wheel, in FIG. 14A, the ground force $F_G$ is distributed on the dual rim. The reaction force $F_L$ applied to the left sliding plug 12 is equal to the reaction force $F_R$ applied to the right sliding plug 12.

Figures 2A, 2B, 2C, 2D, 2E, 3A, 3B, 3C, 3D, 3E, 4A, 4B, 4C, 4D, 4E, 5A, 5B, 5C, 5D, 5E:
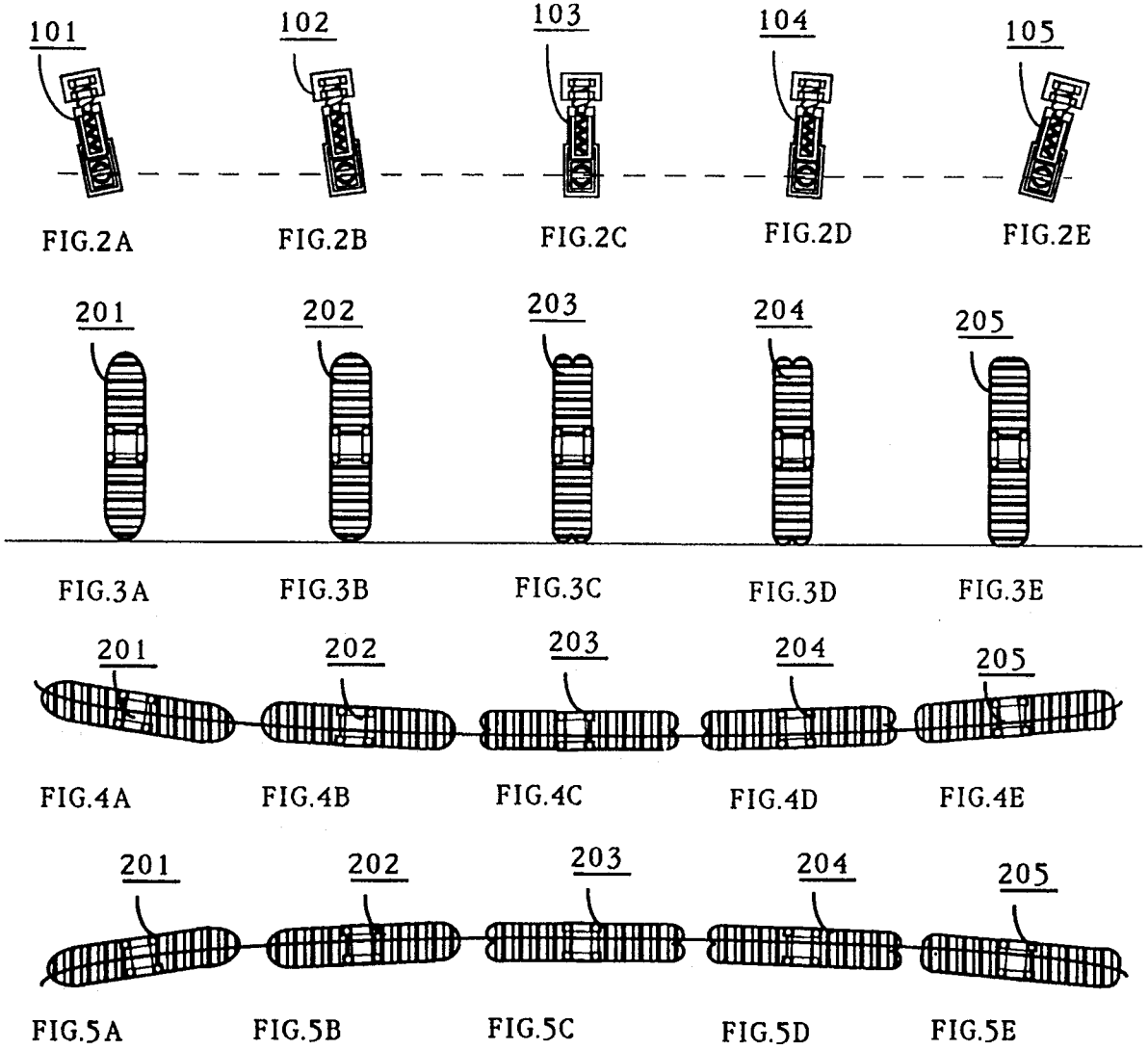
Figure 13A:
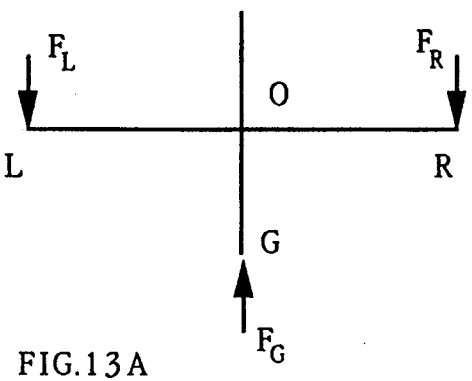
Figure 13B:
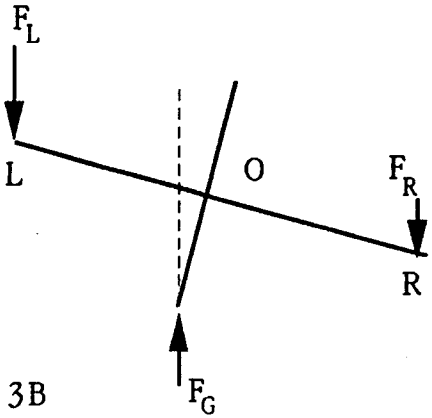
Figure 15B:
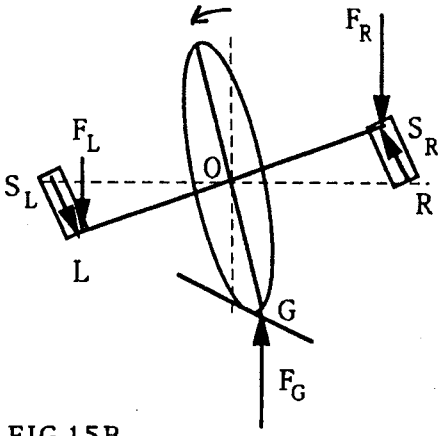
Figure 16B:
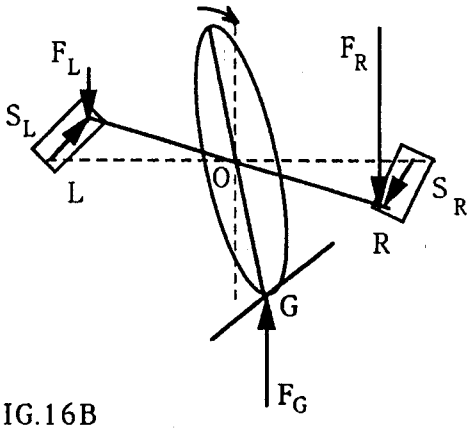
Figure 15A:
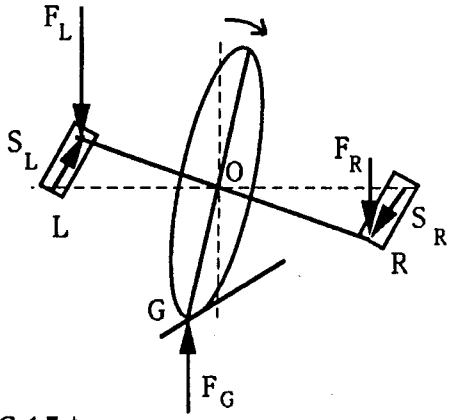
Figure 16A:
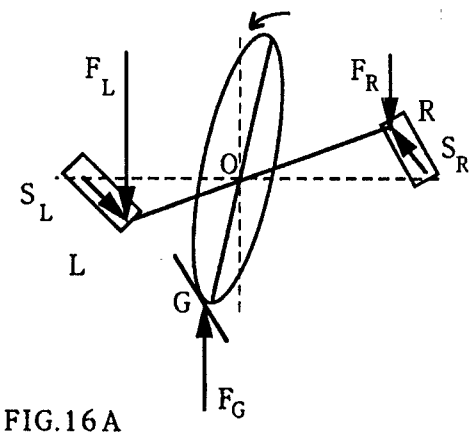

In FIG. 12B, the skater shifts the weight to the right and the frame 4 tilts rightward. The wheel 203 tilts rightward. As shown in FIG. 13B, the reaction force $F_L$ is larger than the reaction force $F_R$. For the dual rim wheel, in FIG. 14B, as the extended line of the ground force FG passes through the left side of the center 0, the reaction force $F_L$ is larger than the reaction force FR. In FIG. 12B, the left sliding plug 12 slides upward and the right sliding plug 12 slides downward. For the front wheel, the guiding slot 19 tilts forward. In FIG. 15A, the upward movement of the sliding plug 12 in the guiding slot $S_L$ and the downward movement of the sliding plug 12 in the guiding slot $S_R$ cause the wheel 201 to turn right as shown in FIG. 4A. For the rear wheel 205 and rear cushion mechanism 105, in FIG. 16A, the upward movement of the sliding plug 12 in the guiding slot $S_L$ and the downward movement of the sliding plug 12 in the guiding slot $S_R$ cause the wheel 205 to turn left as shown in FIG. 4E.

Figure 13C:
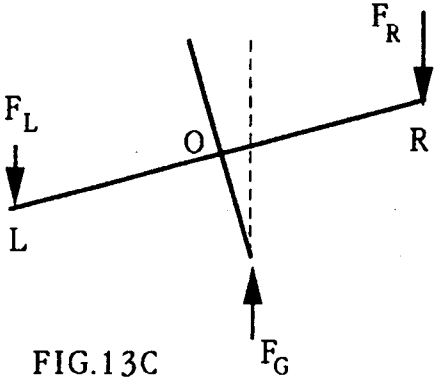
Figure 14A:
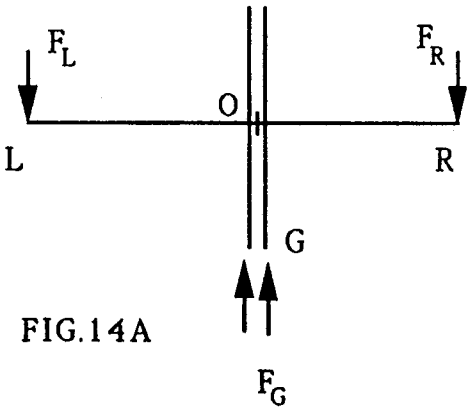
Figure 14B:
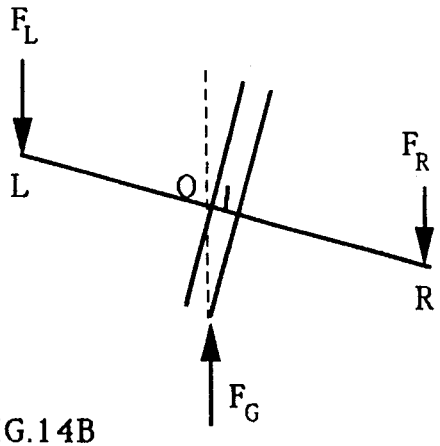
Figure 14C:
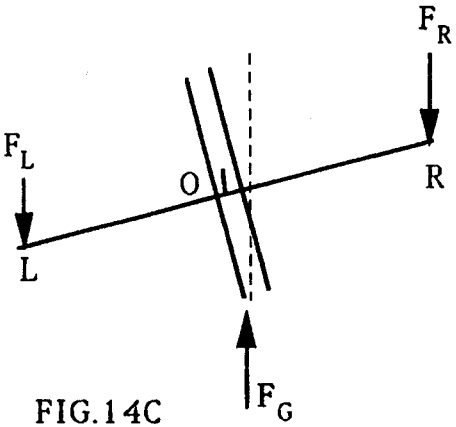

In FIG. 12C, the skater shifts the weight to the left and the frame 4 tilts leftward. The wheel 203 tilts leftward. As shown in FIG. 13C, the reaction force $F_R$ is larger than the reaction force $F_L$. For the dual rim wheel, in FIG. 14C, as the extended line of the ground force $F_G$ passes through the right side of the center 0, the reaction force $F_R$ is larger than the reaction force $F_L$. In FIG. 12C, the right sliding plug 12 slides upward and the left sliding plug 12 slides downward. For the front wheel, the guiding slot 19 tilts forward. In FIG. 15B, the upward movement of the sliding plug 12 in the guiding slot $S_R$ and the downward movement of the sliding plug 12 in the guiding slot $S_L$ cause the wheel 201 to turn left as shown in FIG. 5A. For the rear wheel 205 and rear cushion mechanism 105, in FIG. 16B, the upward movement of the sliding plug 12 in the guiding slot $S_R$ and the downward movement of the sliding plug 12 in the guiding slot $S_L$ cause the wheel 205 to turn right as shown in FIG. 5E.

Figure 17A:
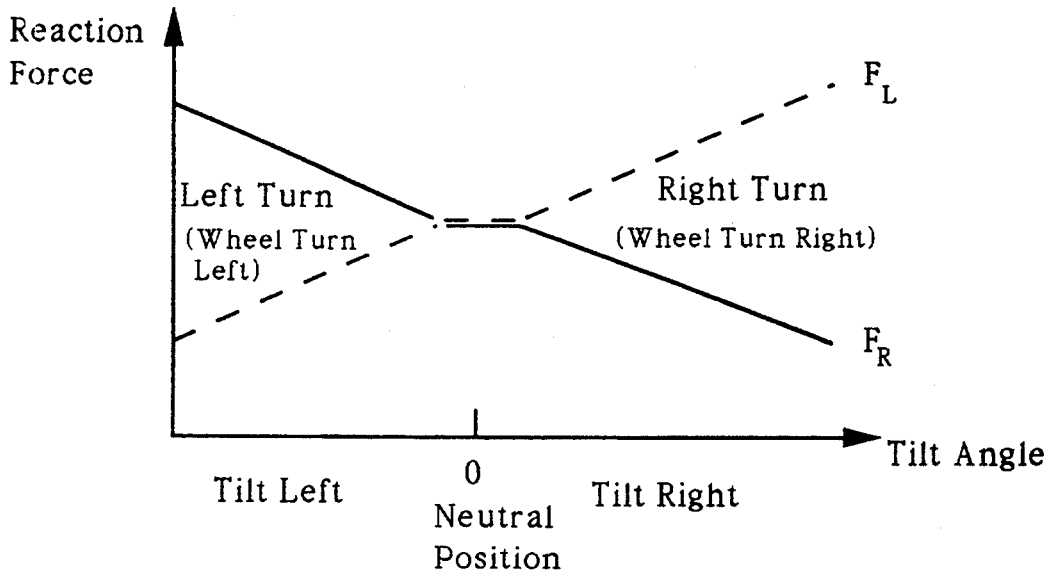

In FIG. 17, it makes the summary for the operation of the cushion mechanism. FIG. 17A is the operation for the cushion mechanism of front wheel. As the shoe 5 stands upright, there is a neutral steady position shown by the horizontal line segment. As the shoe 5 tilts right, the reaction force $F_L$ increases; the reaction force $F_R$ decreases. The front wheel 201 turns right to make a right turn. As the shoe 5 tilts left, the reaction force $F_L$ decreases; the reaction force $F_R$ increases. The front wheel 201 turns left to make a left turn.

Figure 17B:
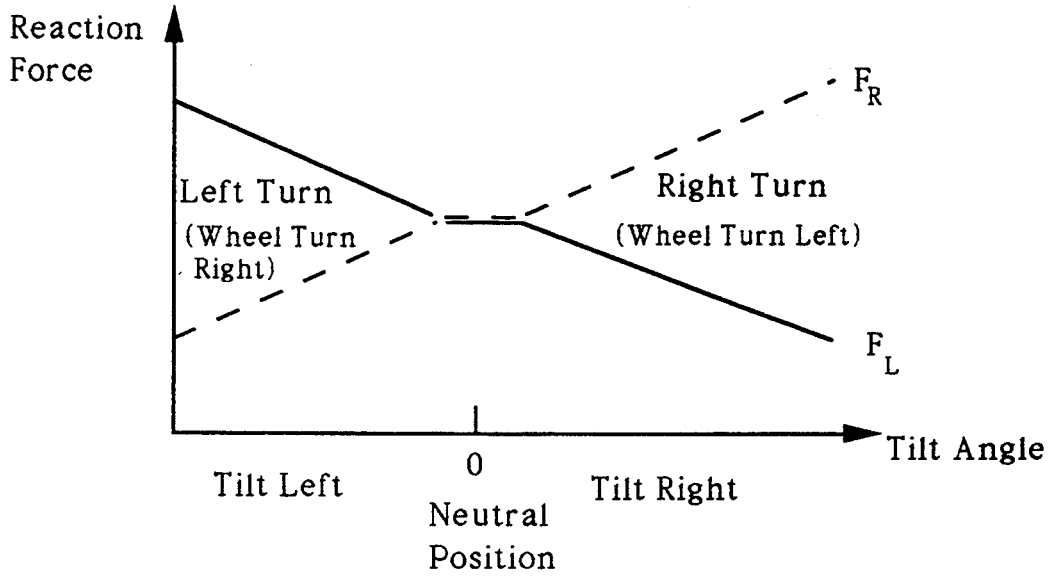

FIG. 17B is the operation for the cushion mechanism of rear wheel. As the shoe 5 stands upright, there is a neutral steady position shown by the horizontal line segment. As the shoe 5 tilts right, the reaction force $F_L$ decreases; the reaction force $F_R$ increases. The rear wheel 205 turns left to makes a right turn. As the shoe 5 tilts left, the reaction force $F_L$ increases; the reaction force $F_R$ decreases. The real wheel 205 turns right to make a left turn.

Figure 18B:
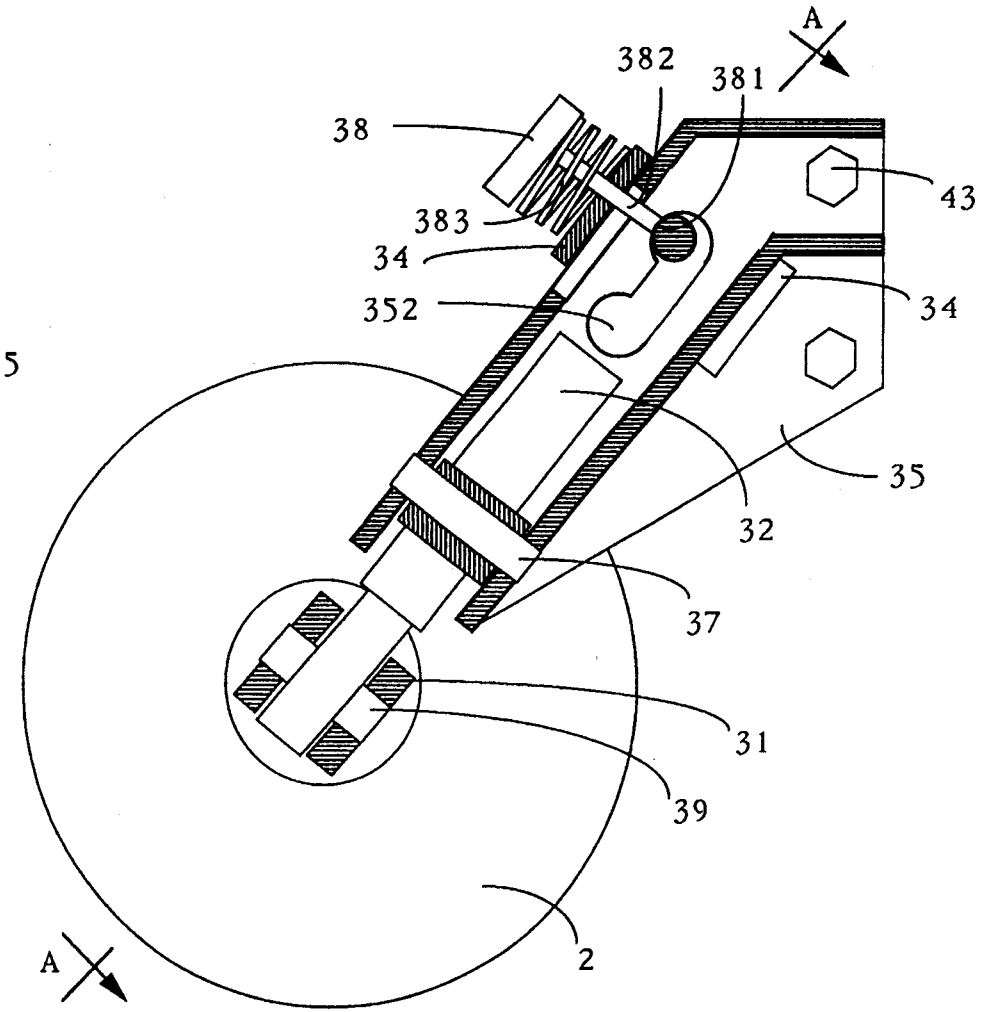
Figure 18A:
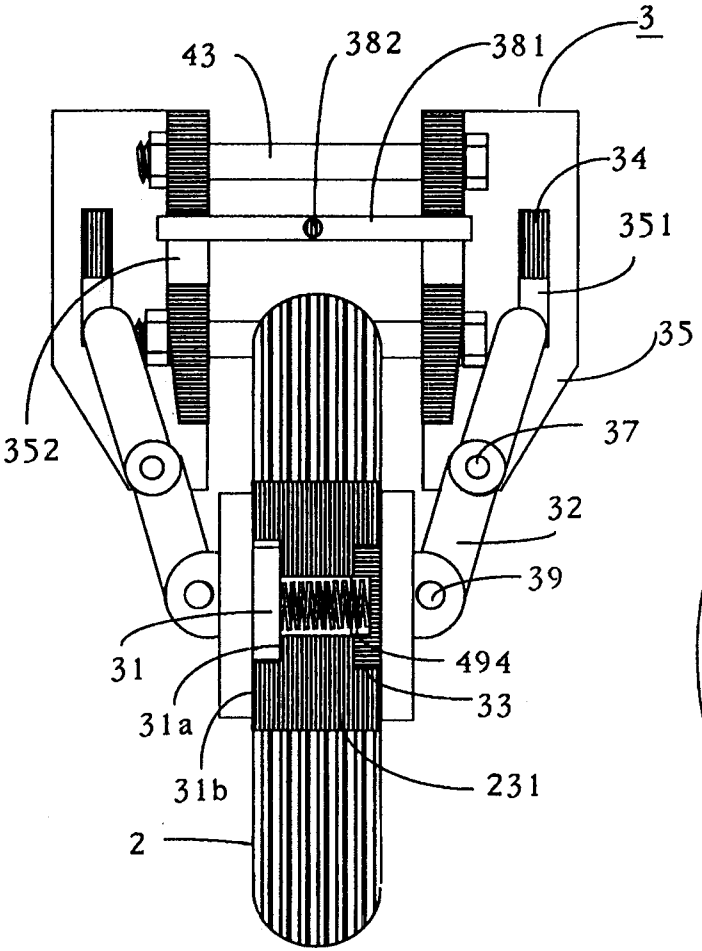

(1) to reduce the worn out speed of brake; (2) to have one extra wheel; (3) to take advantage of the worn wheel to serve as the brakes; (4) to have the pivotal turn; (5) to skate on the nose wheel and tail wheel and (6) to have the foot-operable selection of operational mode, I invent the wheel having the brake function. As shown in FIG. 18, the wheel 2 is rotationally mounted on the brake drum 31. The swivelling arm is pivotally mounted on the frame 35 with the pin 37. The brake drum 31 is pivotally mounted on the swivelling arm 32 with pin 39. The frame 35 is mounted on the frame 4 with the locking screws 43. The biasing spring 36 expands against the brake drum 31. In the normal operation condition, the foot-operable pad 38 is locked with the rod 381 which is locked at the upper hole of the slot 352. The spring 383 expands to bias the rod 382 to have the rod 381 in the lock position. In the normal skate position, the wheel 2 rotates on the brake drum 31 as the normal wheel does. During braking to stop, the skater shifts all the body weight to the brake wheel. The frame 35 moves downward. The swiveling arm 32 swivels inward to clamp the wheel 2. This action is like the disk brake of the automobile. The wheel 2 is equivalent to the disk in the disk brake; the brake drum 31 is equivalent to the friction pad in the disk brake. The more weight is applied to the brake wheel 2, the more friction force to clamp the wheel 2 to stop. The clamping force is applied to the surface 31*a* and 31*b* to clamp the wheel to stop. As the skater removes the body weight, the bias spring 36 expands to separate the brake drum 31 and the wheel 2. The wheel 2 is free to rotate as the normal wheel does.

Figure 19B:
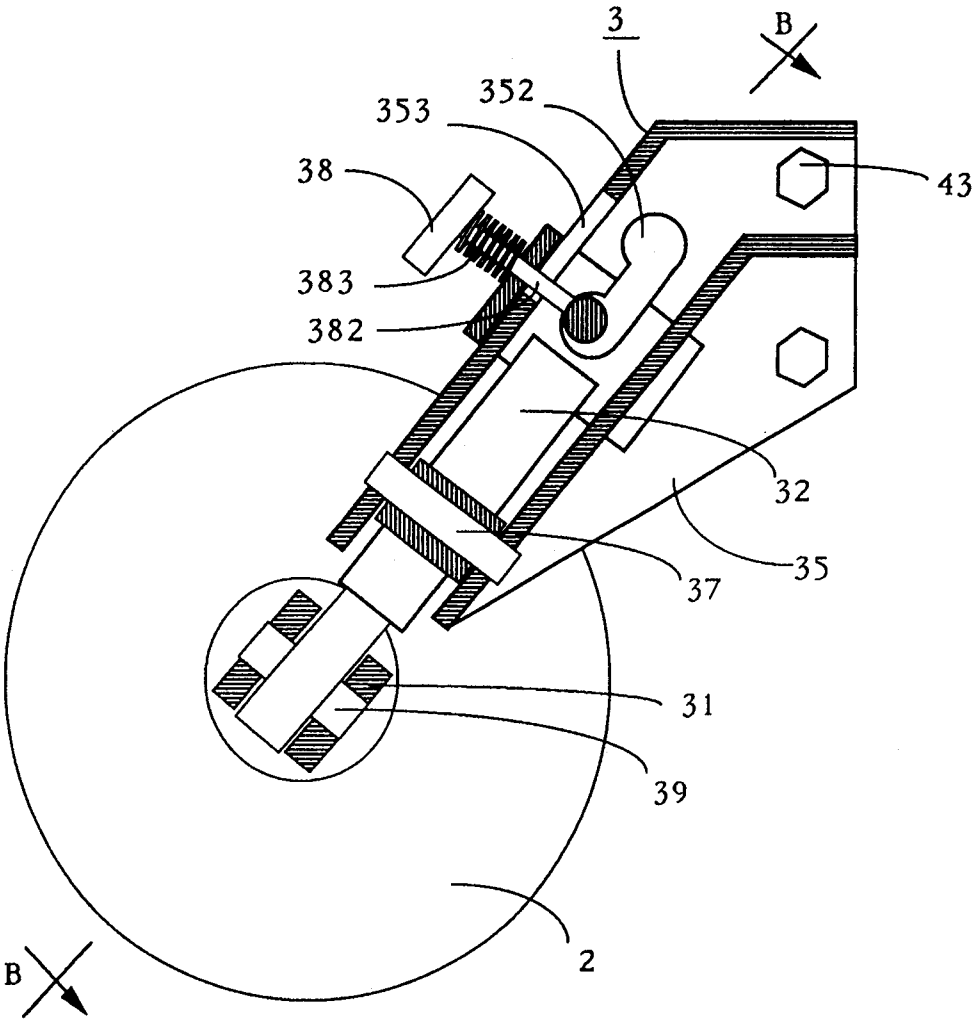
Figure 19A:
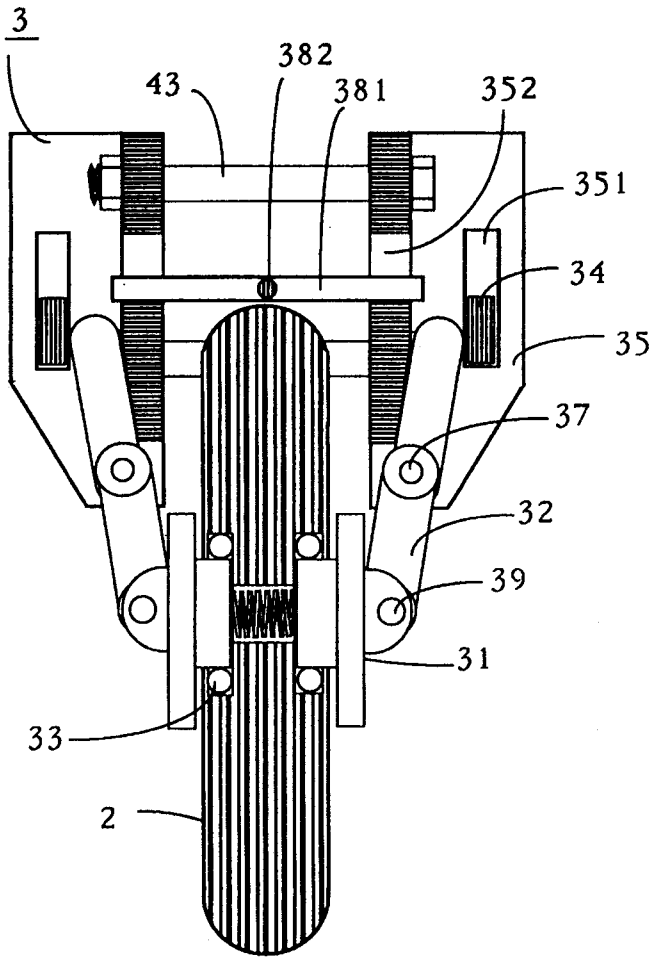

To skate on the brake wheel 3, the skater can step on the pad 38 to press the bias spring 383 downward to move the rod 381 to the lower position—pivotal mode. In FIG. 19, the bracket 34 holds the swiveling arm 32. The bearing 33 is to reduce the friction force as the brake wheel 2 rotates. As the skater applies the weight on the wheel 2, the swiveling arm is held by the bracket 34 that the swiveling arm 32 will not swivel to squeeze the wheel 2. The wheel 2 still rotates free.

Figure 20B:
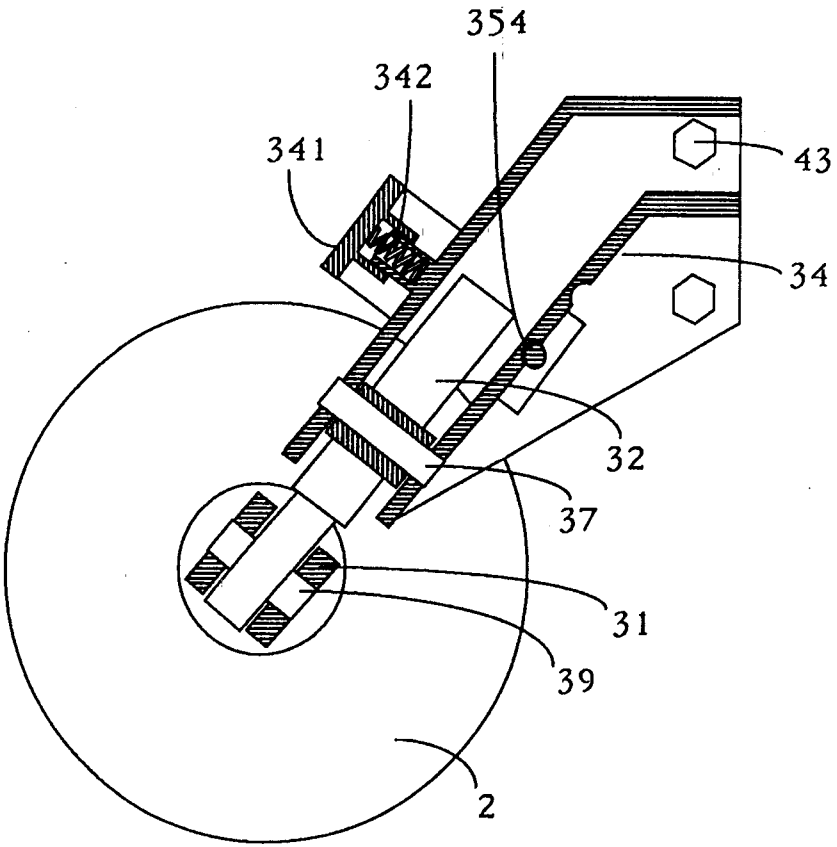
Figure 20A:
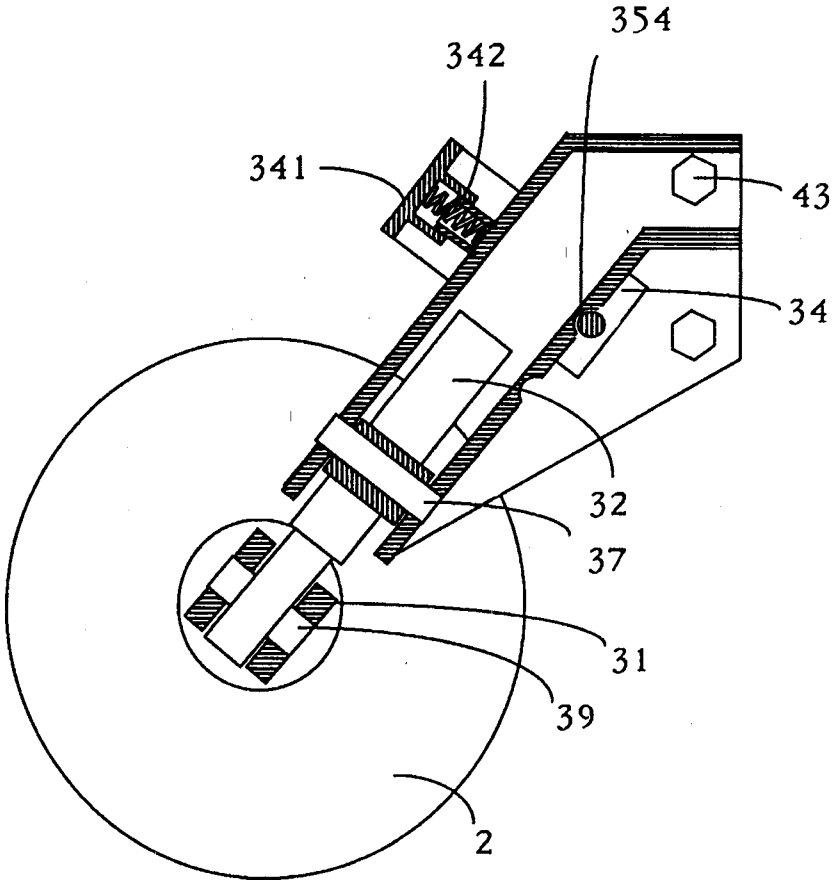
Figure 21B:
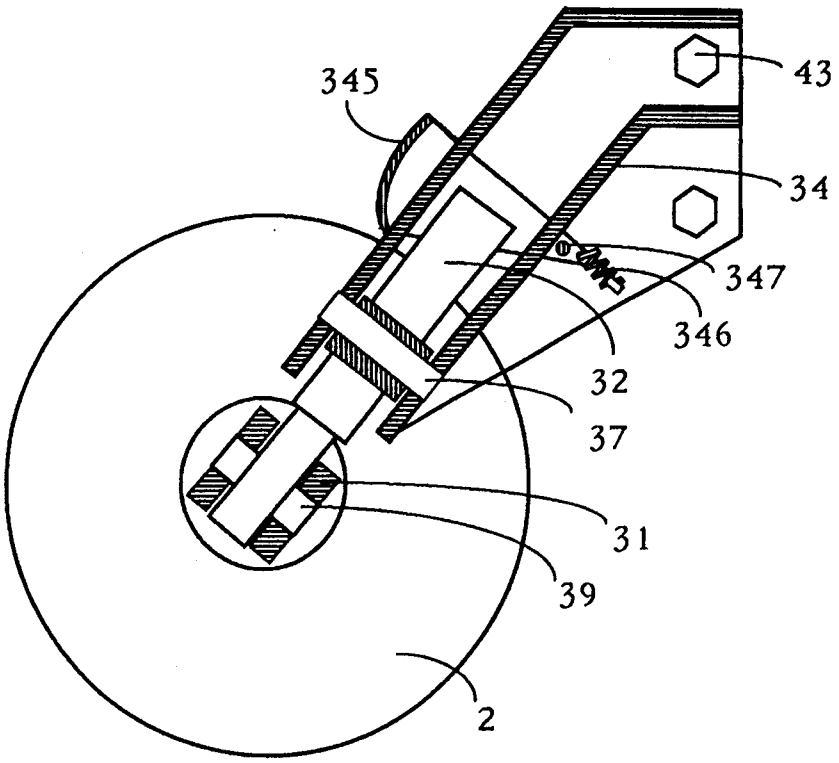
Figure 21A:
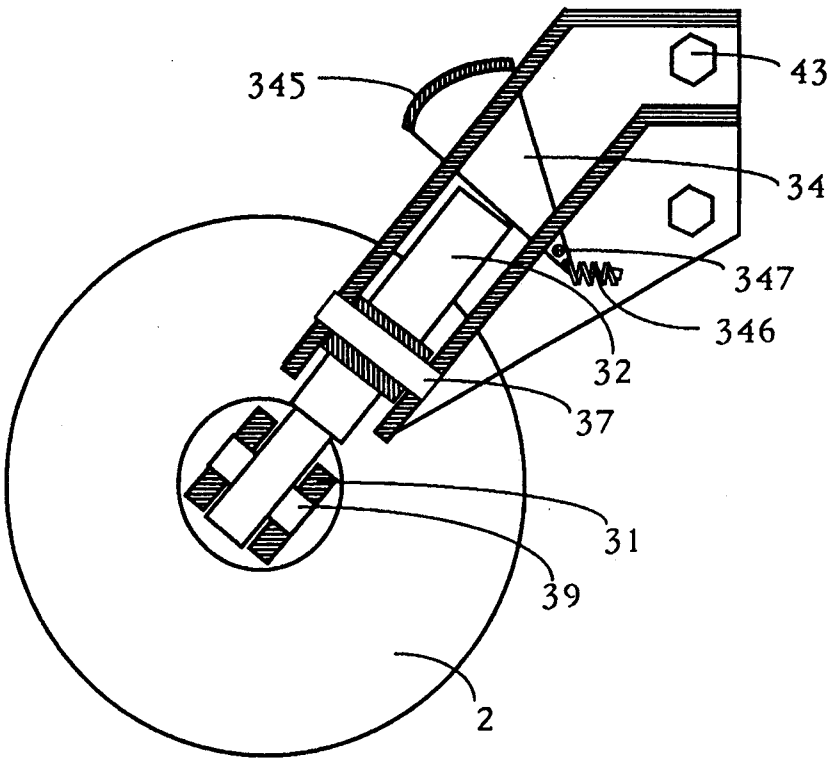

There are many alternative designs for the mechanism of the mode selection. FIG. 20 shows the second implementation. In FIG. 20A, the bracket 341 is biased by the spring 342 to lock in the hole 354. As the bracket 341 is pressed downward, the bracket 341 can shift downward to hold the swiveling arm 32 as shown in FIG. 20B. FIG. 21 shows the third implementation. It is similar to a switch. The pad 345 is pivotally mounted on the pin 347. In FIG. 21A, the pad 345 is locked in the brake mode by the biasing spring 346. As the skater uses the foot to shift the pad 345, in FIG. 21B, the pad 345 is in the pivotal mode to keep the swiveling arm from swiveling.

Figure 22A:
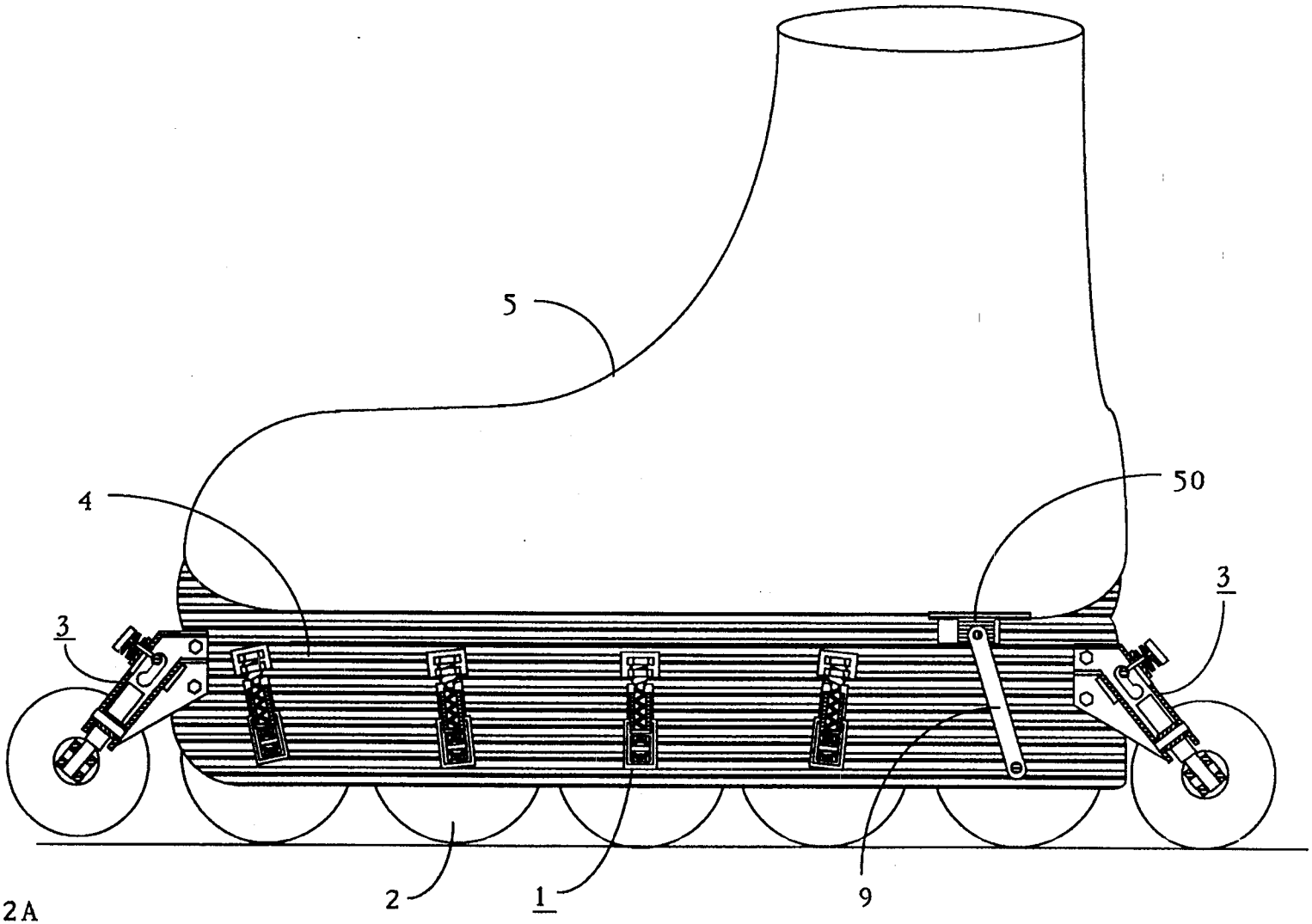
FIG. 22 (A) is the partially exposed self-propelling figure-blade roller skate.
Figure 22B:
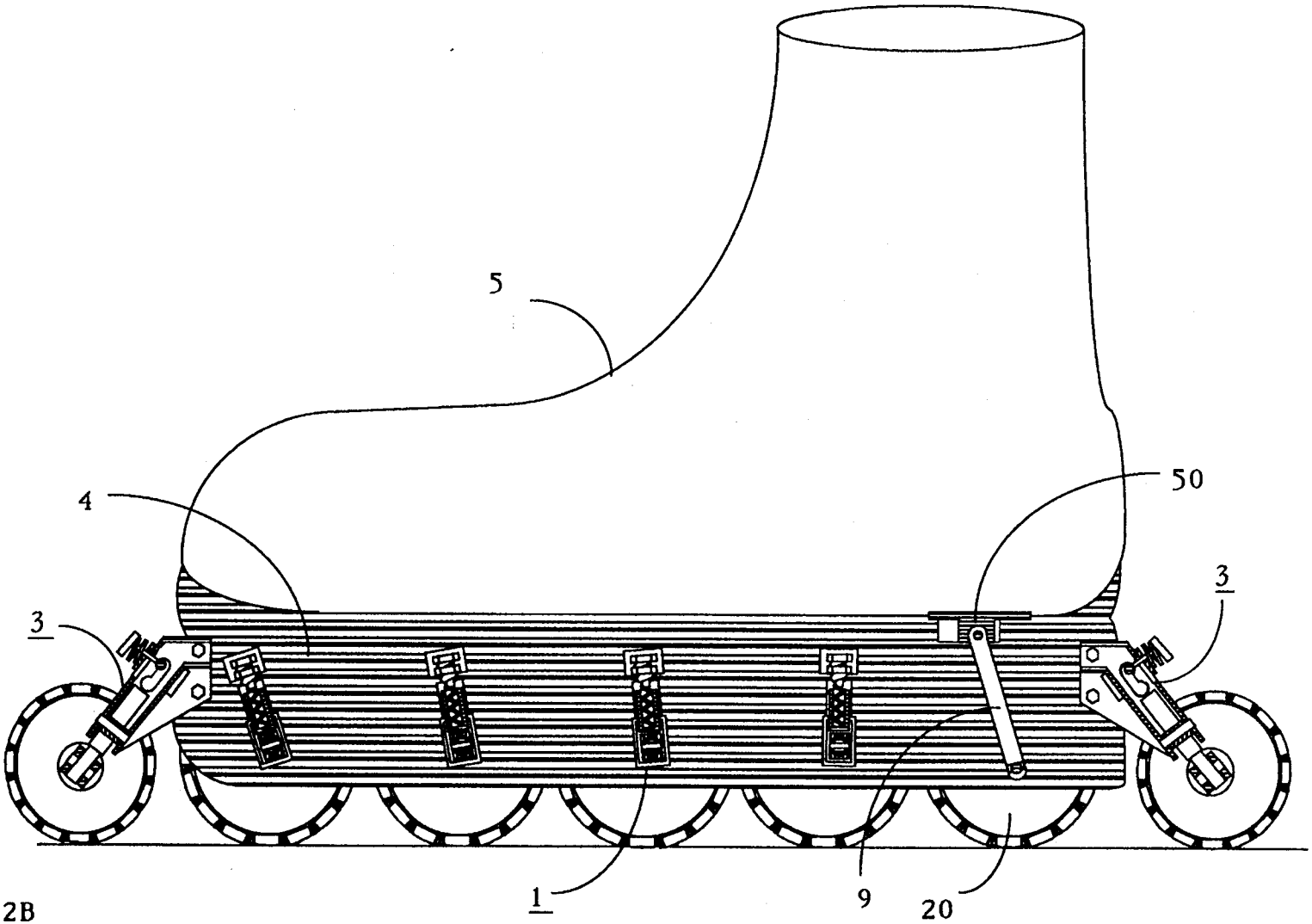
Figure 23:
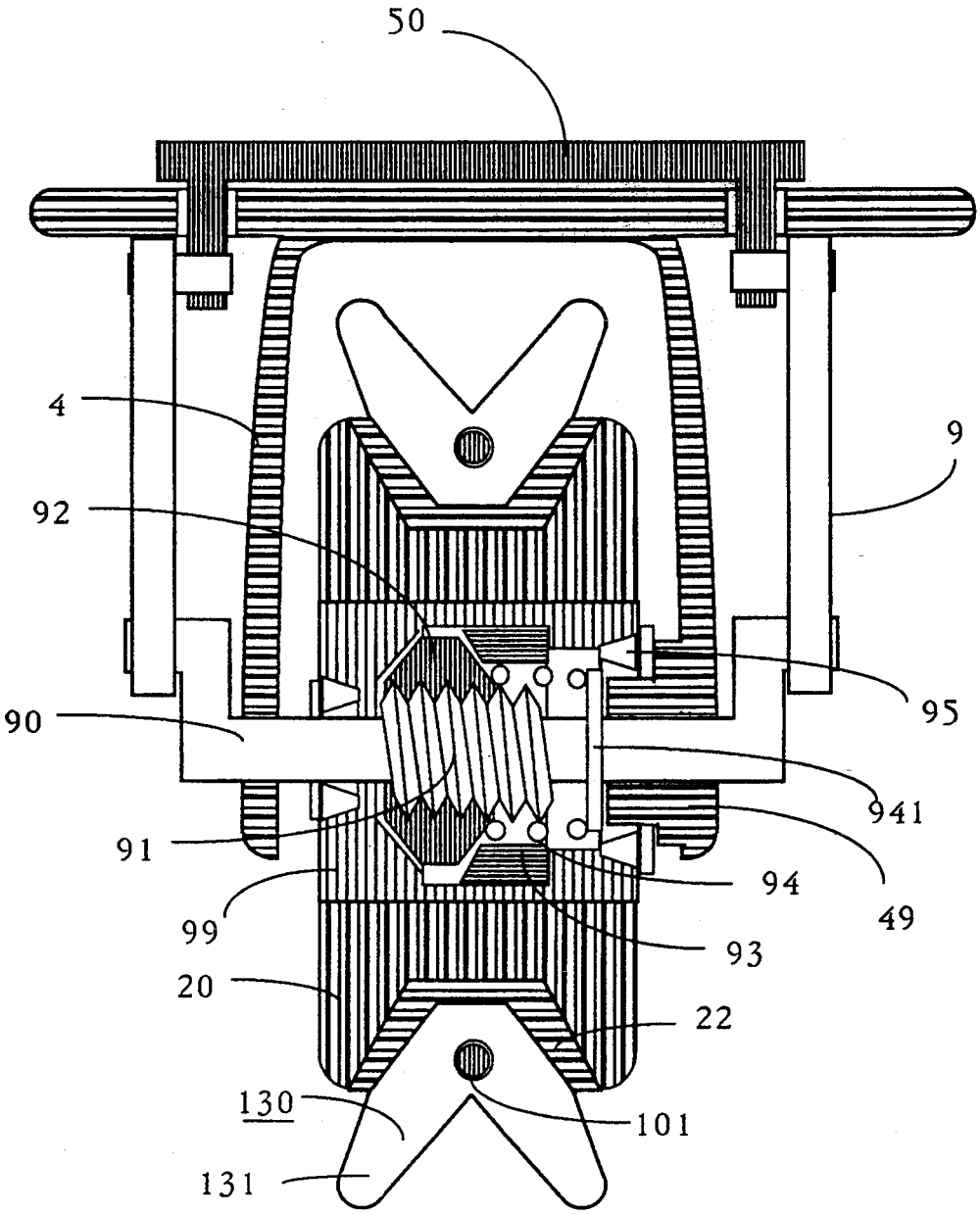
FIG. 23 is the section view of the self-propelling wheel.
Figure 26:
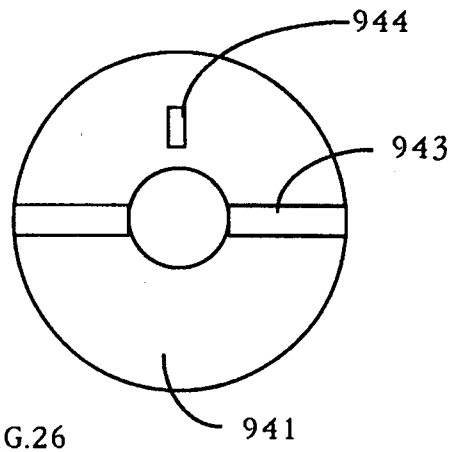
FIG. 26 is the frictional washer plate of the friction holding mechanism of the self-propelling wheel.
Figure 28:
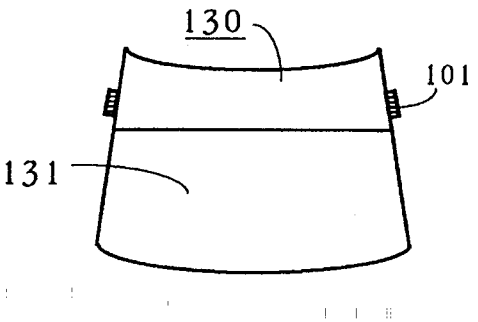
FIG. 28A is the side view of the bead of the driving wheel as shown in FIG. 22B.

There are several skating techniques to skate on the nose wheel or the tail wheel. As shown in FIG. 22, the brake wheel 3 can be mounted at the two ends of the figure-blade roller skate. The self-propelling mechanism can also be applied to the figure-blade roller skate as shown in FIG. 22. In FIG. 23, the skater raises up and steps down the pad 50 to drive the link 9 to roate the crank 90. The screw 91 rotates to shift the engaging drum 92 to engage with the hub 99 to rotate the wheel 20. The resilient belt 22 enwraps around the wheel 20. The roller bead 130 has two forks 131. The roller beads 130 are hooked up to be a chain with the string 101. FIG. 28 is the side view of the roller bead 130 of the driving wheel.

Figure 25:
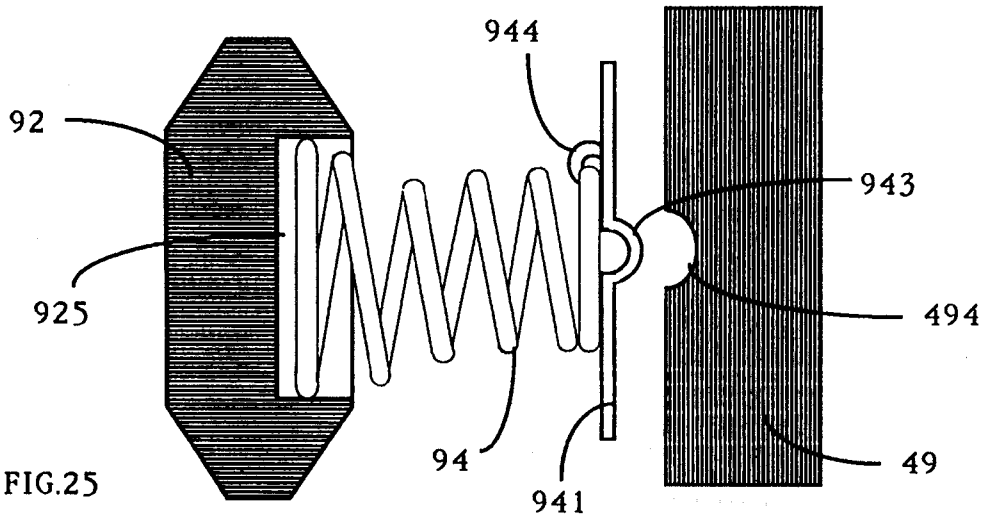
FIG. 25 is an alternative implementation of the friction holding mechanism of the self-propelling wheel.
Figure 24:
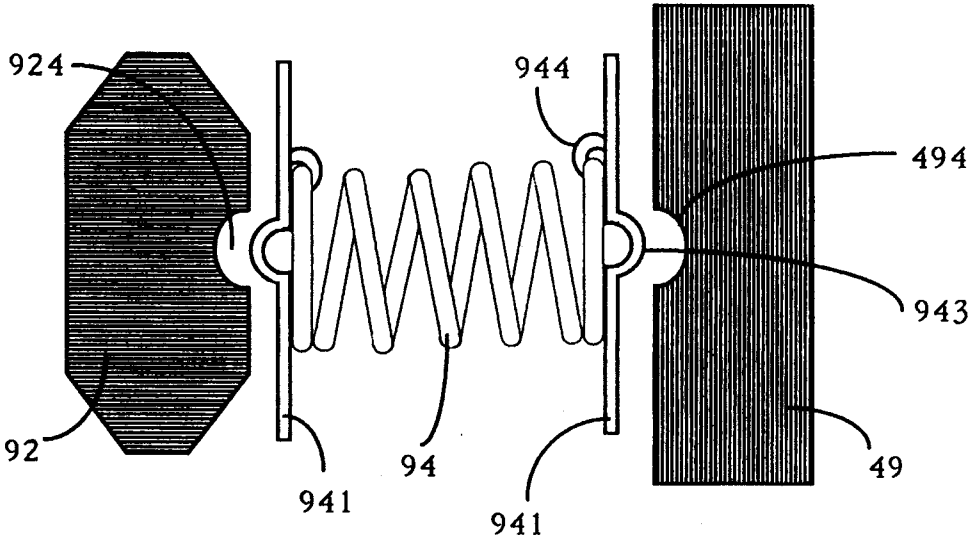
FIG. 24 is an implementation of the friction holding mechanism of the self-propelling wheel.

In FIG. 23, the friction spring 94 is to introduce the friction force to the engaging drum 92. The spring 94 clamps the outside of the engaging drum 92 and biases against the washer 941. FIG. 24 and FIG. 25 show the alternative designs of the friction holding engaging mechanism. The washer plate 941 has a pressed slot 943. This slot 943 fits in the transverse boring 494 to introduce the friction force. The spring 94 expands to introduce the friction force to the engaging drum 92. On the drum 92 there is also a transverse boring 924 to fit the transverse slot 943. In FIG. 25, the spring 94 fits inside the bore 925 to clamp the engaging drum 92.

Figure 27:
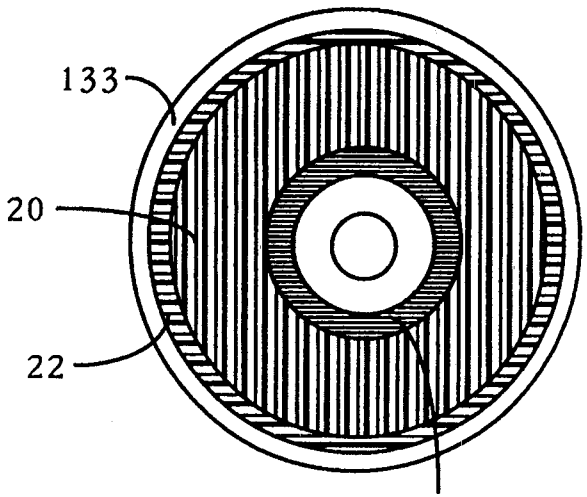
FIG. 27 is the sectional view of the driving wheel having the rim with the fork shape.

FIG. 27 shows the alternative design of the driving wheel. The rim 133, the resilient belt 22 and the wheel are one integral unit.

Figure 29:
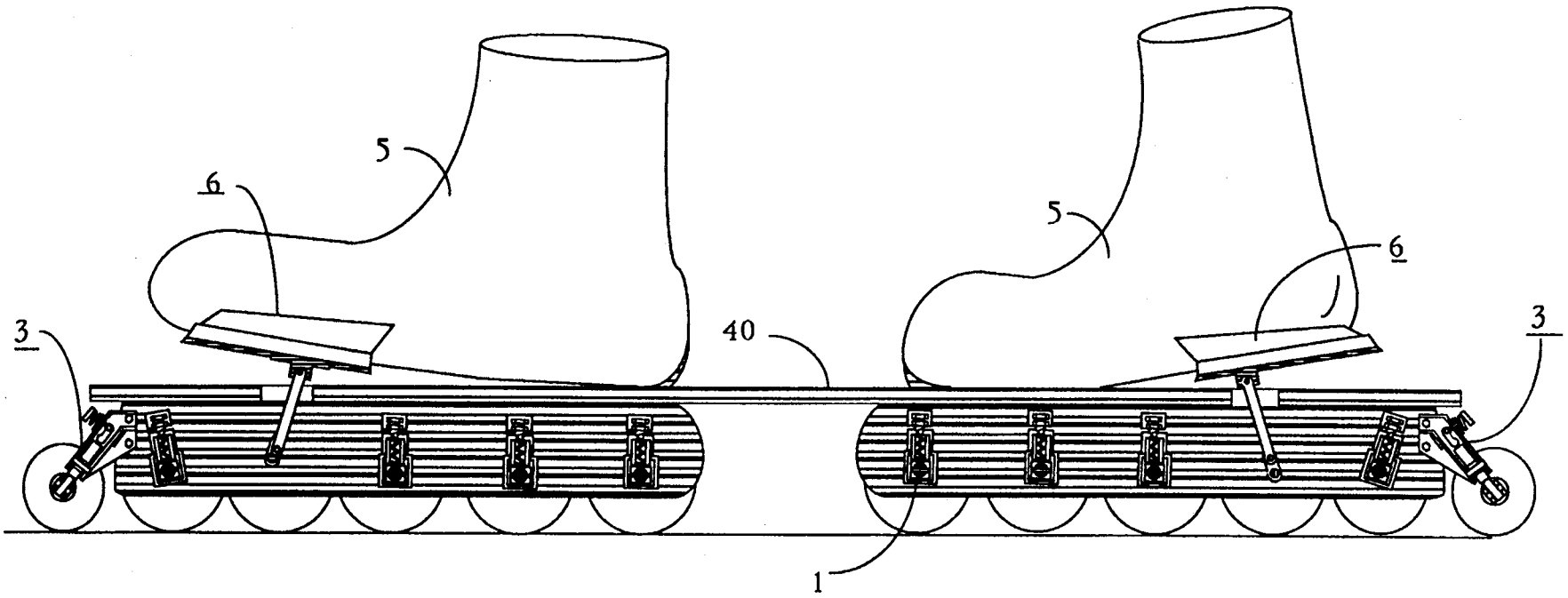
FIG. 29 is the skateboard made of the figure-blade roller skate and the self-propelling wheels.

FIG. 29 shows the skateboard 40 made of the combinatory figure-blade roller skate. The skater steps down and raises up the paddle 6. At the two ends of the skateboard, the steering cushion mechanism inclines forward and backward separately. As the skater shifts the weight to the right, the skateboard 40 will turn right automatically; as the skater shifts the weight to the left, the skateboard 40 will turn left automatically.

Figure 30:
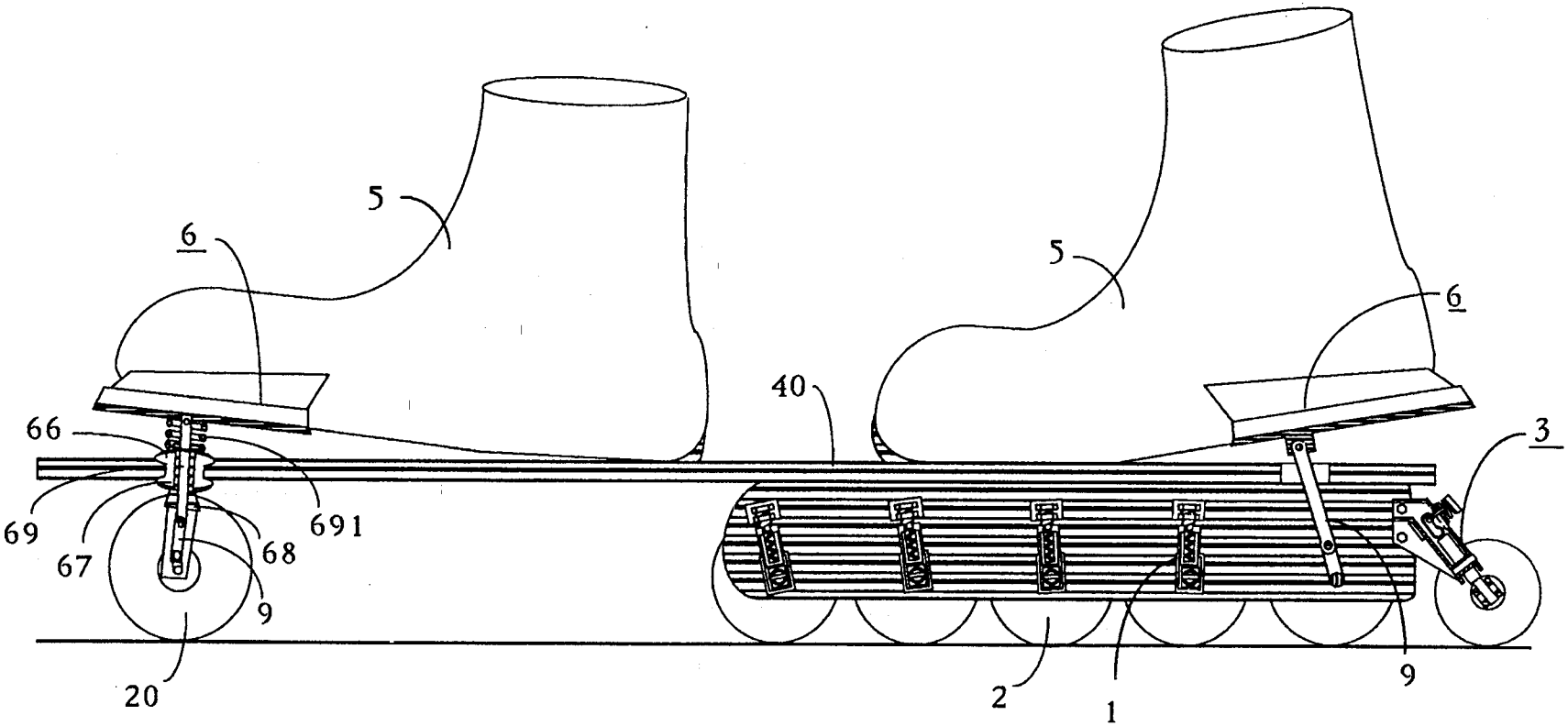
FIG. 30 is the side view of the tri-cycle type skateboard made of the self-propelling wheel and the self-propelling figure-blade roller skate.

FIG. 30 show the skateboard made of the figure-blade roller skate and the self-propelling [roller]wheels. The washer 66 clamps the resilient pad 67 to distribute the reaction force. The spring 691 is to bias the pad 6 upward. The pad 6 serves as the steering means of the skateboard. The pad 6 may rotate to change the direction of the skateboard. The skater steps down and raises up the pad 6 to drive the rod 69 up and down. The rod 69 drives the link 9 to roate the crankshaft and wheel 20 to rotate.

Figure 31:
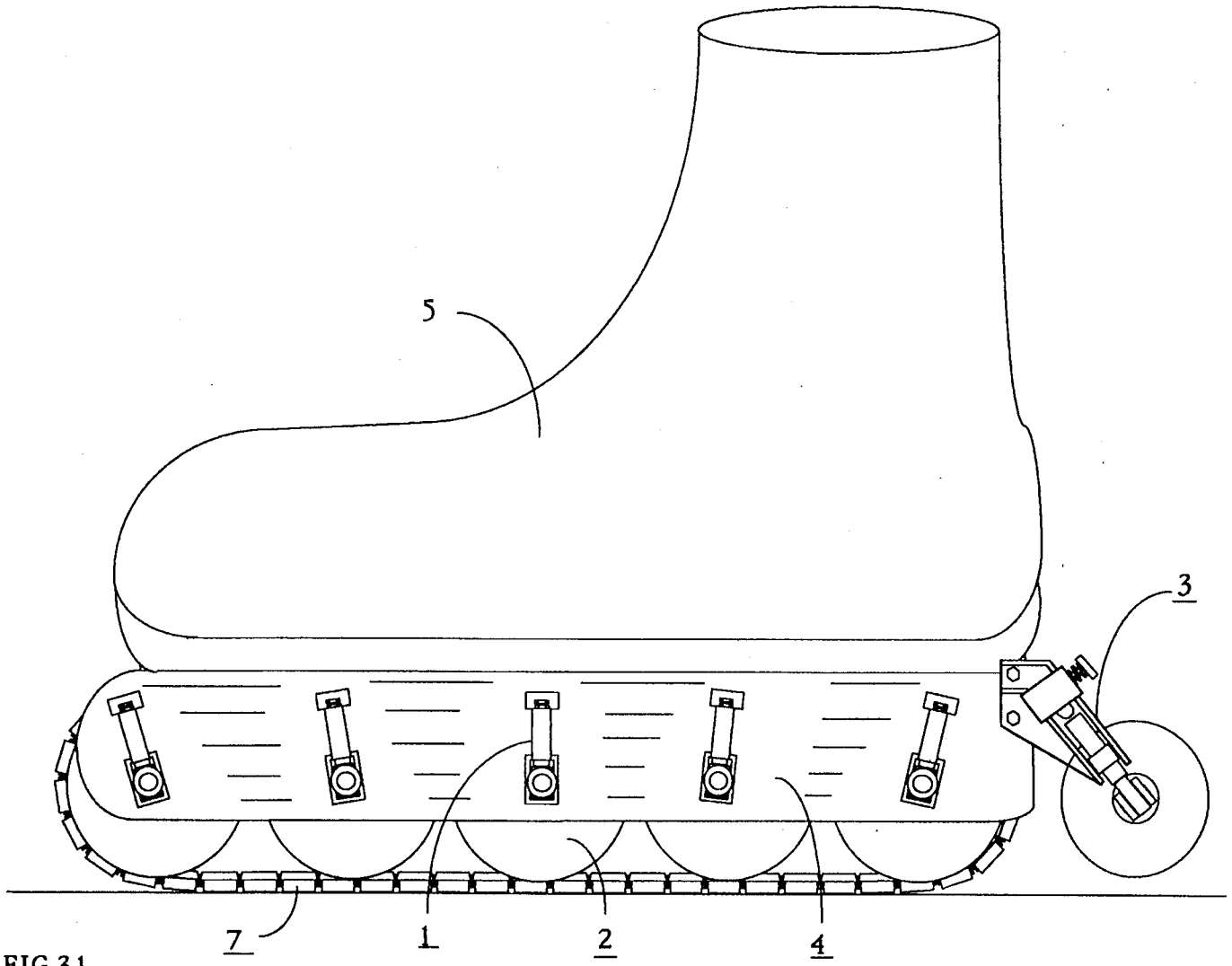
FIG. 31 is the grass-ski type of in-line figure blade roller skate with the flexible chain.
Figure 33:
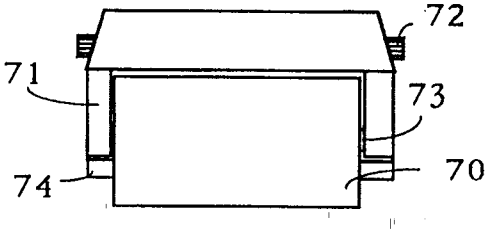
FIG. 33 is the side view of the roller bead of the flexible chain.
Figure 32:
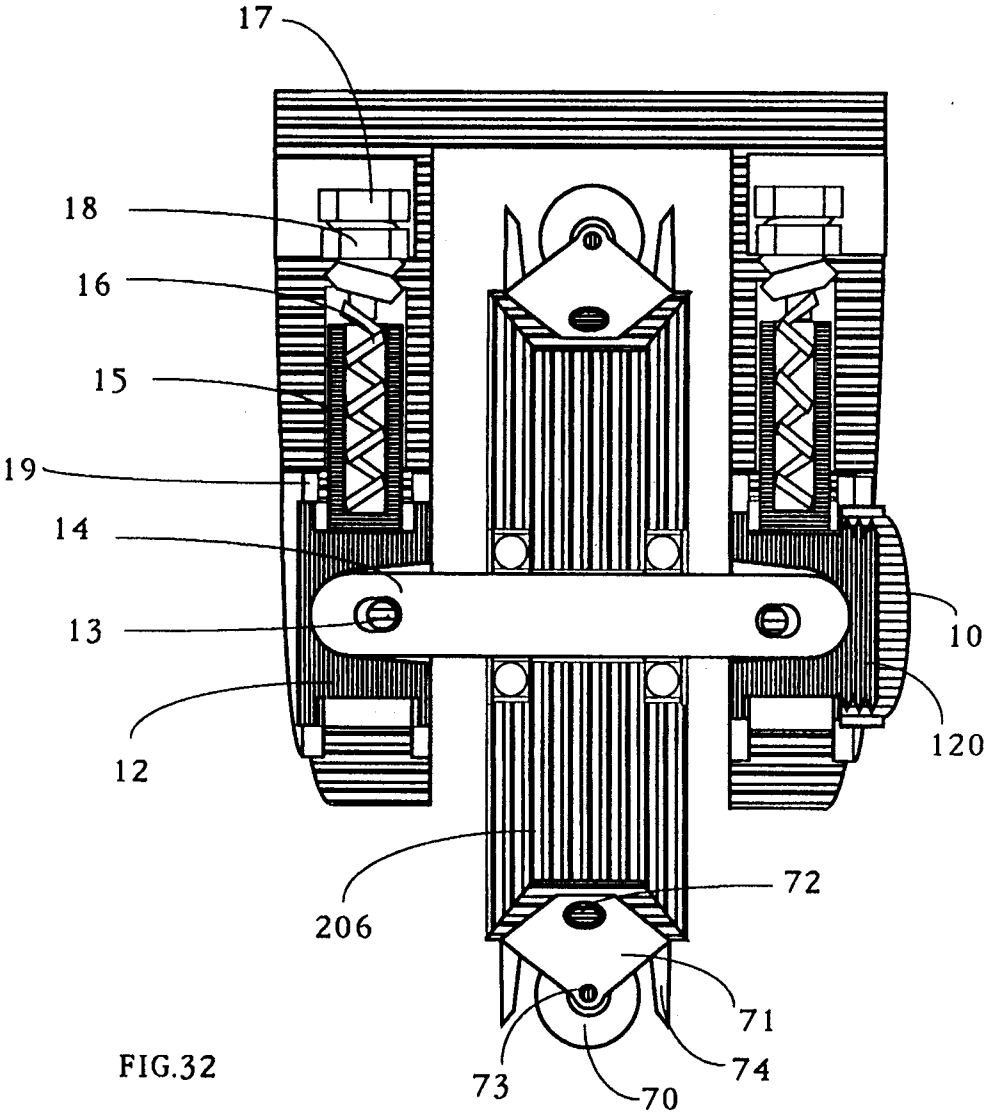
FIG. 32 is the section view of the wheel with the flexible chain.

Furthermore, the chain 7 can enwrap around the wheels 2 as shown in FIG. 31. The section view of the wheel and chain is shown in FIG. 32. The roller bead has the single bead 70 and dual knives 74 as shown in FIG. 33. The bead 70 is rotationally mounted on the pin 73. The pin 73 is supported on the frame 71. The string 72 hooks up several roller beads to be the flexible chain 7. The resilient belt enwraps around the wheel as the cushion between the wheel and the roller beads. With the flexible chain, the figure-blade roller skate has the sideward skating capability.

Figure 35:
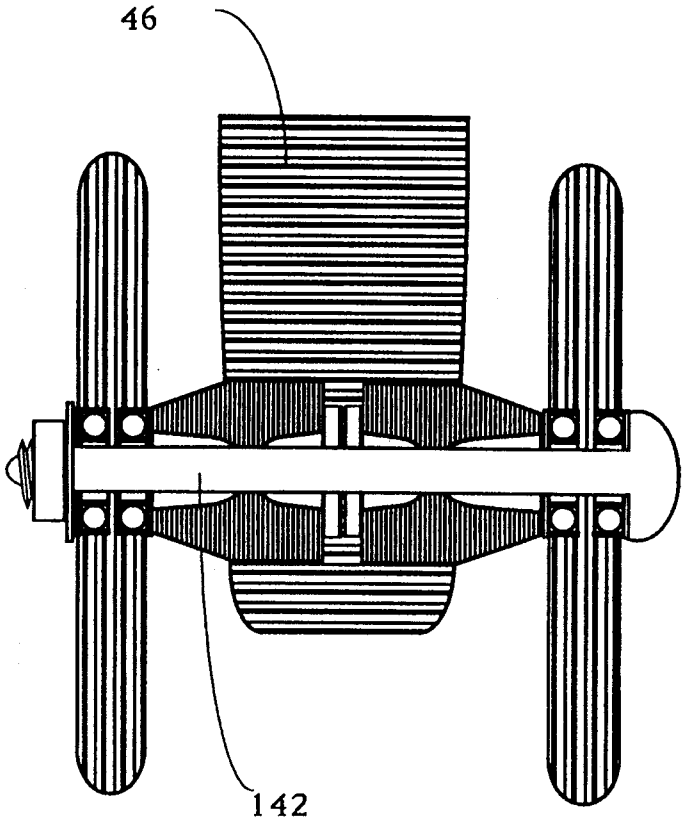
FIG. 35 shows the two-wheel type in-line roller skate with the narrow frame.
Figure 34:
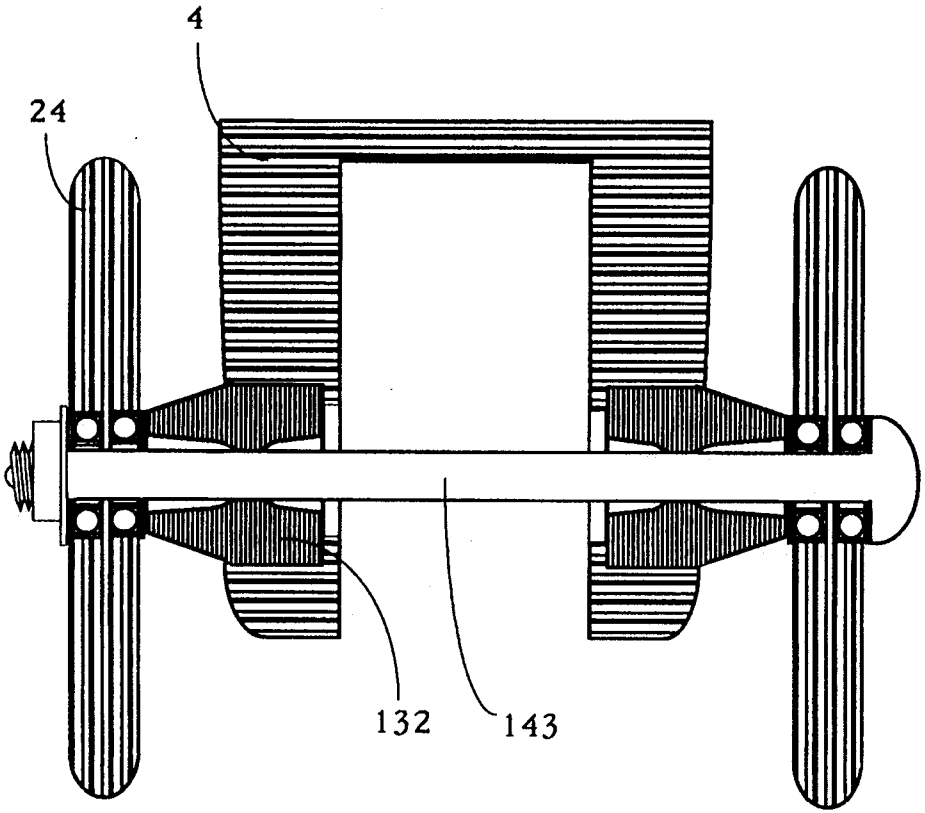
FIG. 34 shows the two-wheel type in-line roller skate.
Figure 36:
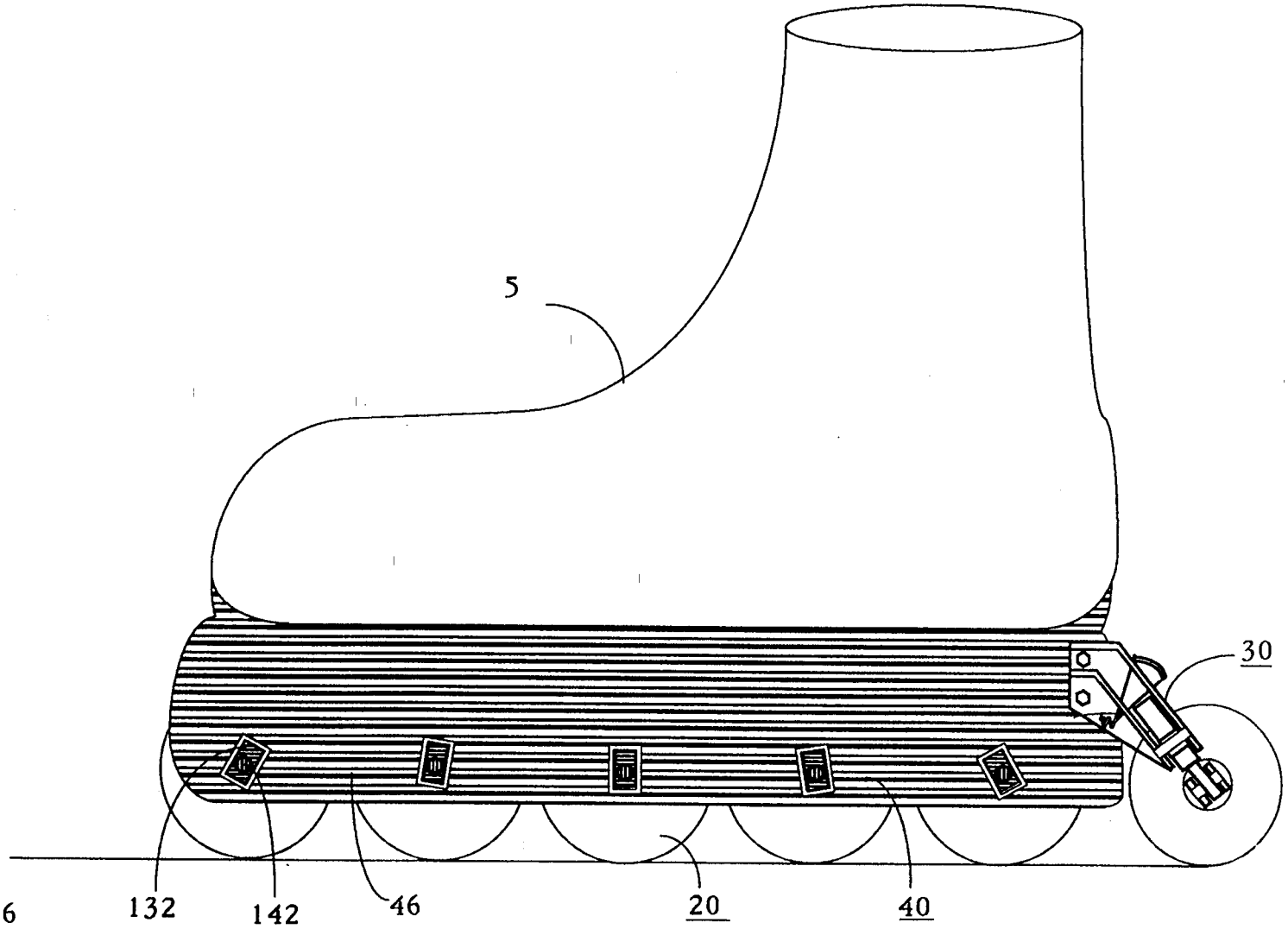
FIG. 36 shows the side-view of the two-wheel type in-line figure-blade roller skate with the guiding slots having the different inclining directions.

To increase the stability in the single foot skating, the tricycle type in-line roller is introduced. As shown in FIG. 34, the resilient cushion 132 is installed in the reversed direction. Two thin wheels 24 are rotationally mounted on the long axle 143. To reduce the lateral dimension, in FIG. 35, the narrow frame 46 is adopted. However, for the two-wheel alignment, as shown in FIG. 36, the inclined directions of the guiding slot are reversed. For the front wheels, the guiding slots incline backward. For the rear wheels, the guiding slots incline forward.

Figure 37:
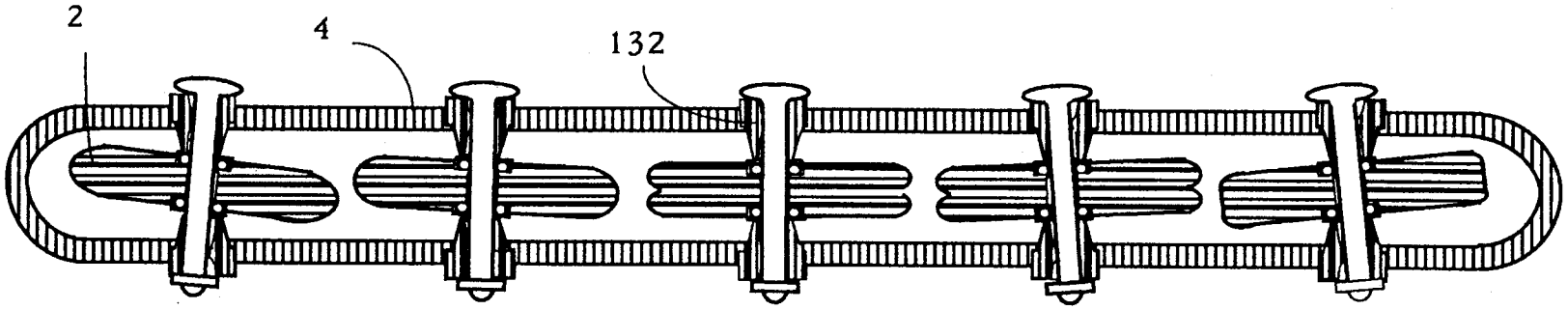
FIG. 37 shows the wheel alignment of the traditional in-line figure blade roller skate.
Figure 38:
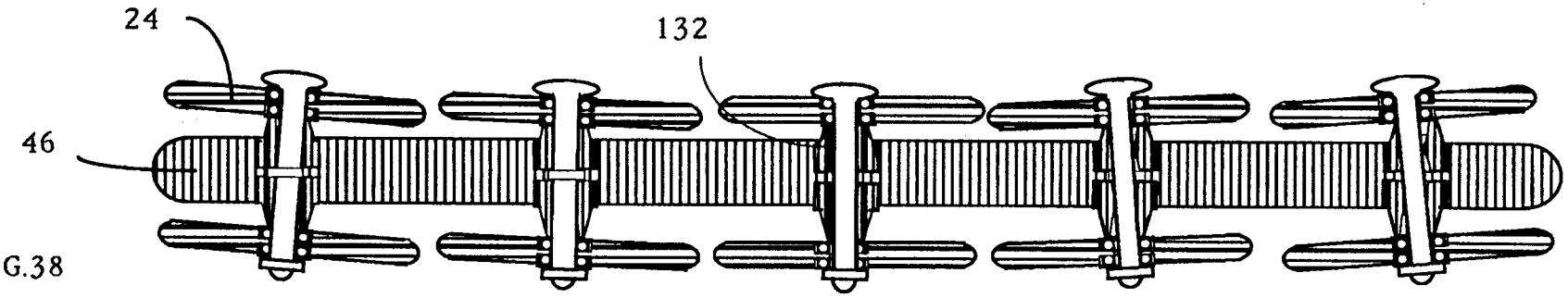
FIG. 38 shows the wheel alignment of the two-wheel type in-line figure blade roller skate.
Figure 39:
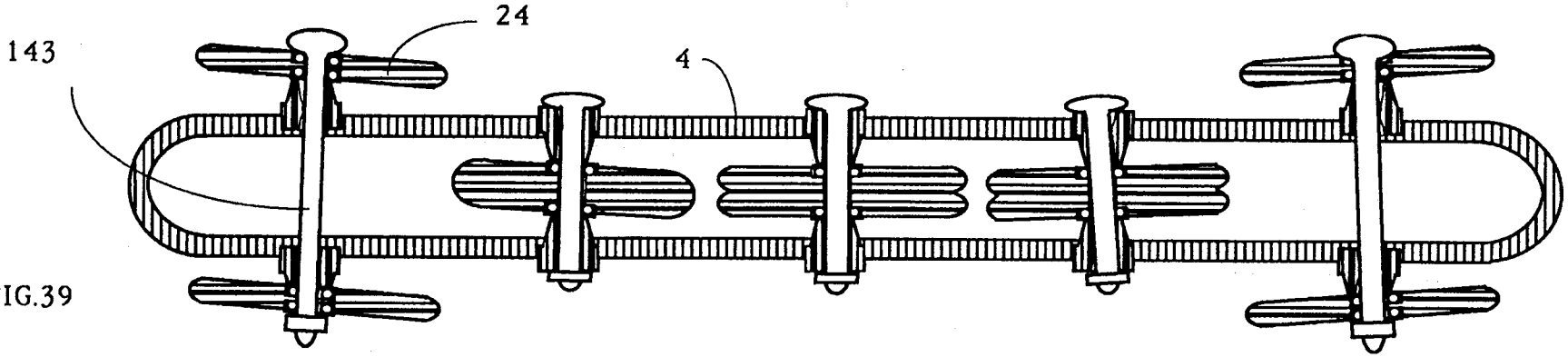
FIG. 39 shows the wheel alignment of the hybrid structure of the two-wheel type and single-wheel type in-line figure blade roller skate.
Figure 40:
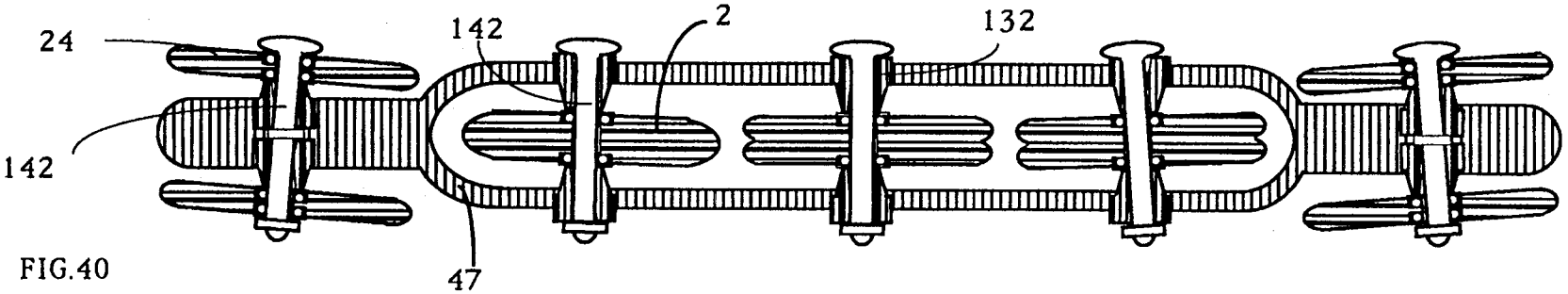
FIG. 40 shows the wheel alignment of the alternative design of the hybrid structure of the two-wheel type and single-wheel type in-line figure blade roller skate.
Figure 41:
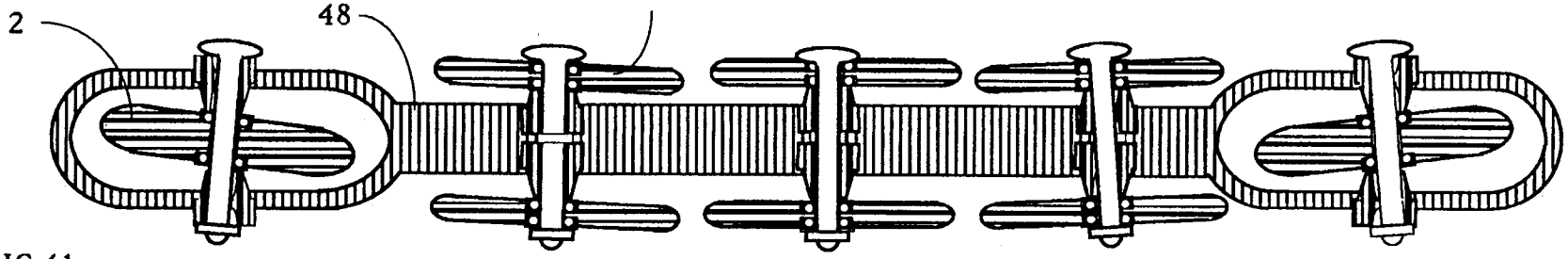
FIG. 41 shows the wheel alignment of the other alternative design of the hybrid structure of the two-wheel type and single-wheel type in-line figure blade roller skate.

From FIG. 37 to FIG. 41, they show the different alignments of the in line roller structure. FIG. 37 is the traditional figure blade in-line roller skate. All the wheels are aligned in one line. FIG. 38 shows the two-wheel type in line figure blade roller skate. FIG. 39 shows the in-line figure blade roller skate has the hybrid structure of the two-wheel and single-wheel structure. FIG. 40 and FIG. 41 shows the alternative design of the hybrid structure of the two-wheel and single-wheel structure.

Figure 42:
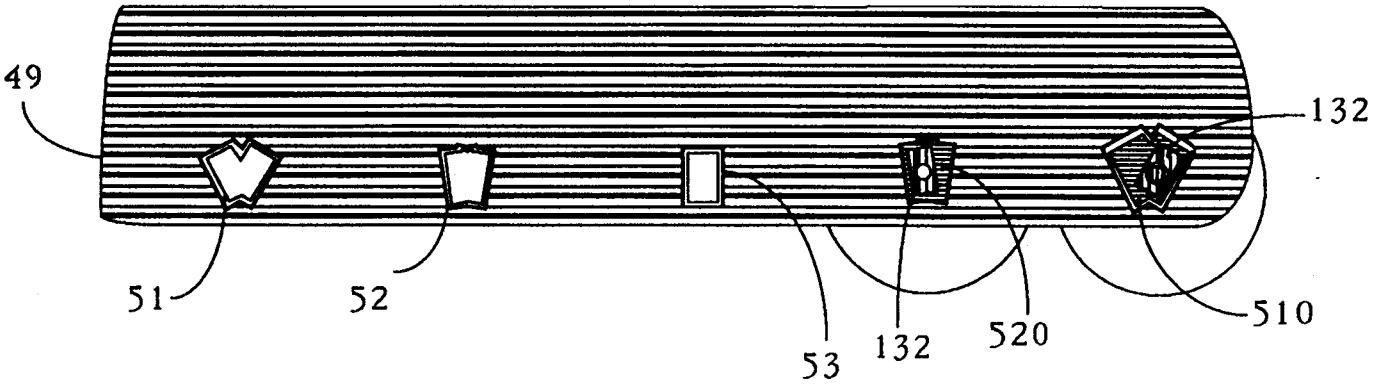
FIG. 42 shows the general purpose design of the frame which can be used for the wheel alignments of FIG. 37 and FIG. 39.
Figure 43E:
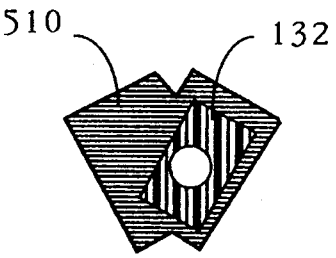
FIG. 43 (A–E) shows the notch, bracket and guiding slot of the first and the last wheels.
Figure 43D:
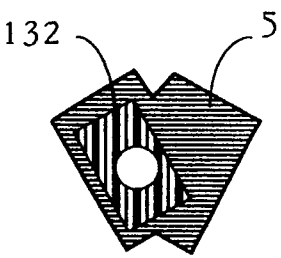
Figure 43C:
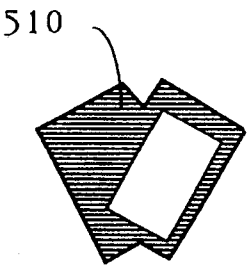
Figure 43B:
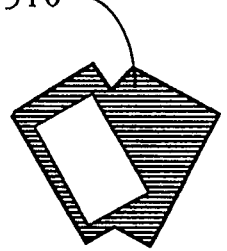
Figure 43A:
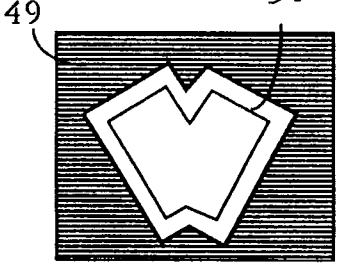
Figure 44A:
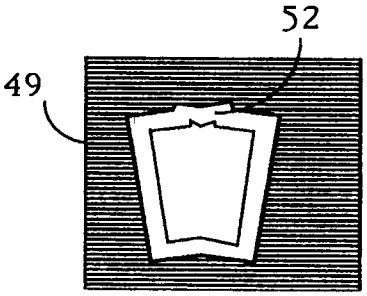
FIG. 44 (A–E) shows the notch, bracket and guiding slot of the second and the second to the last wheels.
Figure 44B:
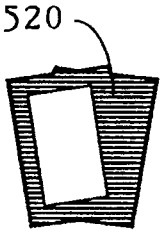
Figure 44C:
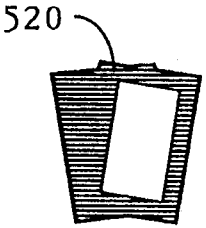
Figure 44D:
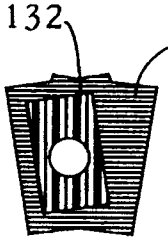
Figure 44E:
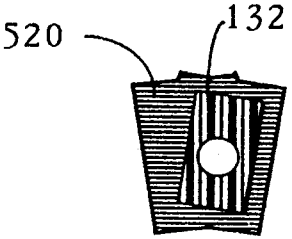
Figure 45A:
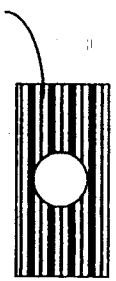
FIG. 45 (A) is the section view of the resilient cushion.
Figure 45B:
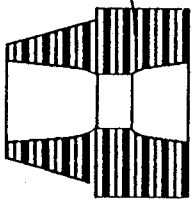

To make the general purpose, we may make the enhancement for the frame 4 to have the the functions of FIG. 37 and FIG. 39 simultaneously. As shown in FIG. 42, the frame 49 has the specially designed notches 51, 52 and 53. As shown in FIG. 43B and FIG. 43C, the bracket kit 510 can fit in the notch 51 in two different directions. As shown in FIG. 43D and FIG. 43E, the resilient cushion 132 can fit in the bracket 510 in two different inclined directions. In FIG. 43D, the guiding slot inclines forward; in FIG. 43E, the guiding slot inclines backward. As shown in FIG. 44B and FIG. 44C, the bracket kit 520 can fit in the notch 52 in two different directions. As shown in FIG. 44D and FIG. 44E, the resilient cushion 132 can fit in the bracket 520 in two different inclined directions. In FIG. 44D, the guiding slot inclines forward; in FIG. 44E, the guiding slot inclines backward. FIG. 45 shows the section view of the general purpose steering resilient cushion. FIG. 42 shows the installation of the general purpose design of the steering resilient cushion.

Although the description above contains many specificities, these should not be construed as limiting the scope of the invention but as merely providing illustrations of some of the presently preferred embodiments of this invention. Thus the scope of the invention should be determined by the appended claims and their legal equivalent, rather than by the examples given.

I claim:

1. A skating apparatus comprising a frame, a plurity of wheels and axles, and a resilient axle clamping support means, said wheels being rotatably mounted on said frame with said axles;

said axles being supported by said resilient axle clamping support means, said frame comprising a seris of pairs of hole means inclined at different angles;

said resilient axle clamping support means being mounted in said hole means on both sides of said frame, said resilient axle clamping support means holding said axles and providing resilient restoring forces to restore said axle to original position, said resilient restoring forces comprising longitudinal restoring force along an axis of said axle and transverse restoring force along an axis of said hole means;

tilting said skating apparatus, said resilient axle clamping support means being distorted to adjust said axles to align said wheels to form a curved track to change the skating direction.

2. A skating apparatus according to claim 1, wherein said wheels are rotatably mounted on said axles with bearings, said resilient axle clamping support means pressing against said bearings to offer said logitudinal restoring force to said wheels to keep said wheels be rotatably mounted in position on said axles.

3. A skating apparatus according to claim 1, wherein said axles have flange means, said resilient axle clamping support means being clamped between said frame and said flange means to offer said resilient restoring force.

4. A skating apparatus according to claim 1, wherein a plurality of pairs of said hole means at front portion of said frame incline forward;

said wheels fitting in said pairs of hole means at front portion of said frame being mounted inside said frame;

as skater shifts his weight rightward, said resilient axle clamping support means being distorted to adjust said axles to rotate said wheels to curve towards the right; as skater shifts his weight leftward, said resilient axle clamping support means being distorted to adjust said axles to rotate said wheels to curve towards the left.

5. A skating apparatus according to claim 1, wherein a plurality of pairs of said hole means at front portion of said frame incline backward;

a pair of said wheels corresponding to each pair of said hole means at front portion of said frame being mounted outside said frame;

as skater shifts his weight rightward, said resilient axle clamping support means being distorted to adjust said axles to rotate said wheels to curve towards the right; as skater shifts his weight leftward, said resilient axle clamping support means being distorted to adjust said axles to rotate said wheels to curve towards the left.

6. A skating apparatus according to claim 1, wherein a plurality of pairs of said hole means at rear portion of said frame incline backward;

said wheels fitting in said pairs of hole means at rear portion of said frame being mounted inside said frame;

as skater shifts his weight rightward, said resilient axle clamping support means being distorted to adjust said axles to rotate said wheels to curve towards the right; as skater shifts his weight leftward, said resilient axle clamping support means being distorted to adjust said axles to rotate said wheels to curve towards the left.

7. A skating apparatus according to claim 1, wherein a plurality of pairs of said hole means at rear portion of said frame incline forward;

a pair of said wheels corresponding to each pair of said hole means at rear portion of said frame being mounted outside said frame;

as skater shifts his weight rightward, said resilient axle clamping support means being distorted to adjust said axles to rotate said wheels to curve towards the right;

as skater shifts his weight leftward, said resilient axle clamping support means being distorted to adjust said axles to rotate said wheels to curve towards the left.

8. A skating apparatus according to claim 1, further comprising a bracket kit for each of said hole means, said bracket kit comprising said hole means;

said resilient axle clamping support means fitting inside said bracket kit;

flipping over said bracket kit to change said hole means from inclining forward to inclining backward and vice versa.

9. A skating apparatus according to claim 1, said hole means being slots, said resilient axle clamping support means having a spring biasing against a sliding plug fitting inside each of said slots to provide said resilient restoring force to said axles.

10. A skating apparatus according to claim 1, further comprising roller chains, said wheels having a groove on its rim, a resilient belt fitting inside said groove, said roller chains comprising beads, said beads being hooked up with a string to wrap around said wheels with said resilient belt as the cushion.

11. A skating apparatus according to claim 1 further comprising a first brake wheel mounted on one end of said frame with a bracket mechanism, said bracket mechanism comprising a bracket, two swivel arms and two disks, said two swivel arms pivotally mounted on said bracket, said two disks being pivotally mounted on the ends of said two swivel arms, said brack wheel being rotatably mounted on said disks, under body weight, said swiveling arms being bended to clamp and stop said disks from rotation.

12. A skating apparatus according to claim 11, further comprising bearings, said brack wheel being rotatably mounted on said bearings and said bearing being mounted on said disks.

13. A skating apparatus according to claim 11, further comprising a movable blockage pivotally mounted on said bracket, said blockage being movable to lock said swiveling arms not to swivel; as said movable blockage releasing said swiveling arms, said swiveling arm being free to clamp said disks to apply friction force to said brake wheel.

14. A skating apparatus according to claim 11, said movable blockage being biased with an expanding spring.

15. A skating apparatus according to claim 1 further comprising a self-propelling means, said self-propelling means being coupled to one of said wheels to drive said skating apparatus.

16. A skating apparatus according to claim 15, wherein said self-propelling means comprising a pad, a link, a crankshaft with screws, a hub, a friction holding means and an engaging drum, said friction holding means applying friction force to said engaging drum;

said screws being knotched on said crankshaft and said engaging drum being shifted by said screws;

said pad driving said link, said link rotating said crankshaft, said crankshaft rotating to shift said engaging drum right and left to engage said engaging drums with said hub to rotate.

17. A skating apparatus according to claim 15 further comprising an elongated board and a self-propelled wheel, said self-propelled wheel being mounted on the front portion of said elongated board, said frame being mounted on the rear portion of said elongated board.

18. A skating apparatus according to claim 15, wherein said self-propelled wheel further comprising steering means to rotate said wheel.

19. A skating apparatus comprising a frame, a plurality of wheels, a brake wheel and a bracket mechanism, said plurality of wheels being rotatably mounted on said frame;

said bracket mechanism comprising a bracket, two disks and two swiveling arms, said bracket being mounted on one end of said frame, said swiveling arms being pivotally mounted on said bracket, said disks being pivotally mounted on ends of said swiveling arms, said brake wheel being rotatably mounted on said disks.

20. A skating apparatus according to claim 19, further comprising bearings, said brake wheel being rotatably mounted on said bearings and said bearing being mounted on said disks, under body weight, said swivelling arms being bended to clamp and stop said disks from rotation.

21. A skating apparatus according to claim 19 further comprising a movable blockage pivotally mounted on said bracket, said blockage being movable to lock said swiveling arms not to swivel; as said movable blockage releasing said swiveling arms, said swiveling arm being free to clamp said disks to apply friction force to said brake wheel.

22. A skating apparatus according to claim 21, said movable blockage being biased with an expanding spring.

23. A skating apparatus according to claim 19 further comprising a movable blockage slidingly mounted on said bracket, said blockage being slidable to lock said swiveling arms not to swivel; as said movable blockage releasing said swiveling arms, said swiveling arm being free to clamp said disks to apply friction force to said brake wheel.

24. A skating apparatus according to claim 23, said movable blockage being biased to lock with a spring.

25. A skating apparatus according to claim 1, wherein said wheels comprise twin rims being separated by a notch, said twin rims having functions as two knives of an ice skate, said rims of said wheels form a curved track to turn direction in skating.

* * * * *